US005775823A

United States Patent [19]

Bekki et al.

[11] Patent Number: 5,775,823

[45] Date of Patent: Jul. 7, 1998

[54] AUTOMATIC SHEET FEEDER

[75] Inventors: Toshihiko Bekki, Kawasaki; Hiroharu Nakajima, Chiba; Toshihide Wada, Yokohama; Noriyuki Sugiyama, Kawasaki; Hisatsugu Naito, Tokyo, all of Japan

[73] Assignee: Canon Kabushiki Kaisha

[21] Appl. No.: 717,678

[22] Filed: Sep. 23, 1996

Related U.S. Application Data

[63] Continuation of Ser. No. 82,959, Jun. 29, 1993, abandoned.

[30] Foreign Application Priority Data

| | | | |
|---|---|---|---|
| Jun. 30, 1992 | [JP] | Japan | 4-173414 |
| Jun. 30, 1992 | [JP] | Japan | 4-173415 |
| Jul. 10, 1992 | [JP] | Japan | 4-207494 |
| Jan. 19, 1993 | [JP] | Japan | 5-006924 |
| Jan. 19, 1993 | [JP] | Japan | 5-006981 |
| Jan. 19, 1993 | [JP] | Japan | 5-006982 |

[51] Int. Cl.[6] ..... B41J 11/58

[52] U.S. Cl. ..... 400/629; 400/624; 400/636.1; 271/118

[58] Field of Search ..... 400/624, 625, 400/629, 636.1; 271/21, 109, 117, 118, 119, 226, 236, 245, 246, 247

[56] References Cited

U.S. PATENT DOCUMENTS

| | | | |
|---|---|---|---|
| 4,319,740 | 3/1982 | Ulseth | 271/119 |
| 4,635,922 | 1/1987 | Roetter et al. | 271/119 |
| 4,881,837 | 11/1989 | Falconieri et al. | 400/629 |
| 4,888,602 | 12/1989 | Watanabe et al. | 346/134 |
| 5,011,124 | 4/1991 | Sardano et al. | 271/35 |
| 5,120,042 | 6/1992 | Goto et al. | 271/117 |
| 5,120,043 | 6/1992 | Marzullo | 271/117 |
| 5,255,903 | 10/1993 | Parsons et al. | 271/119 |
| 5,531,531 | 7/1996 | Hirano | 400/629 |

FOREIGN PATENT DOCUMENTS

| | | | |
|---|---|---|---|
| 320246 | 6/1989 | European Pat. Off. . | |
| 487326 | 5/1992 | European Pat. Off. . | |
| 58-125537 | 7/1983 | Japan | 271/109 |
| 59-190132 | 10/1984 | Japan | 271/109 |
| 62-152767 | 7/1987 | Japan | 400/636.1 |

*Primary Examiner*—David A. Wiecking
*Attorney, Agent, or Firm*—Fitzpatrick, Cella, Harper & Scinto

[57] ABSTRACT

An automatic sheet feeding apparatus includes a sheet supporting device for supporting a sheet; an auxiliary roller for feeding a sheet supported on the sheet supporting device; a separating device, having a separation roller and a friction separation device, for feeding one-by-one the sheet; a feeder for feeding the sheet separated by the separating means; auxiliary roller moving device for moving the auxiliary roller between an operative position where the auxiliary roller is in contact with the sheet and an inoperative position where it is away therefrom; a separation roller moving device for moving the separation roller between an operative position where the separation roller is in contact with the friction separating device and an inoperative position where the separation roller is away therefrom; wherein the auxiliary roller moving device and the separation roller moving device move the auxiliary roller and the separation roller from their operative positions to inoperative positions after the feeder starts to feed the sheet separated by the separation roller.

19 Claims, 32 Drawing Sheets

540
529
529a
512
529
538
530
531
538
549
502
(1)
(2)
(3)
(4)
(5)

CPU
21
22
PRNT STRT
PRNT END
JAM
SHEET, PRESENT OR ABSENT
REC DEVICE
CONT CKT
203
209
213
12
10
9
19
20
210
4
8
18
200
21
22
17
7
6
S (1)
(2)
(3)
(4)
(5)
326
321
321a
306
302
306b
322
304
8
4
315
306a
305
316
317
302
318e
314
3
313
318d
310a
309
310
320a
319
318b

AUTOMATIC SHEET FEEDER

This application is a continuation of application Ser. No. 08/082,959, filed Jun. 29, 1993, now abandoned.

FIELD OF THE INVENTION AND RELATED ART

The present invention relates to an automatic sheet feeder and a recording apparatus usable with a printer, a copying machine, a word processor, a personal computer, a facsimile machine or a machine combining two or more of them.

In a known sheet feeding apparatus, there are provided a separation roller rotating in a direction of sheet feeding and high friction separation member contacted to the separation roller, and the sheets are fed out one-by-one.

In such sheet separating means, a friction separating member is urged to a separation roller by a spring, and when the separated sheet is already fed by feeding means in the recording station side, the sheet is gripped between the separation roller and the friction separating member, so that the sheet receives a large backward tension.

If the backward tension is too large, the linearly of the sheet conveyance is deteriorated with the possible result of inclined feeding or sheet jam. With the large backward tension, the feeding means of the recording station side is required to provide a large conveying power with the result of bulky apparatus.

In order to decrease the backward tension, a crescent separation roller (D-cut roller) has been proposed, and it is used with a cylindrical idler roller at a position faced to the friction separating member on the driving shaft of the separating roller.

In this structure, the cut-away portion of the separating roller is faced to the fed-out sheet so as to prevent the sheet from being gripped by the high friction separation roller and the friction separating member and two grip the sheet between low friction idler roller and the friction separating member, by which the backward tension is reduced.

However, even in such an improved structure, the reduction of the backward tension is not sufficient in that the gripping force for the sheet by the idler roller and the friction separating means is simply smaller than the conventional separation roller and that certain degree of tension force is applied to the sheet always.

If the spring force for urging the friction separating means in an attempt to enhance the separation performance, the gripping force between the idler roller and the friction separating means increases correspondingly, with the result of increased backward tension.

As long as the backward tension exists, the feeding means is required to have corresponding feeding power. This becomes a significant problem when the size of the apparatus is reduced by reducing the size of the motor (conveying means) or the like.

If a crescent roller is used, the amount of sheet feed is fixed, and therefore, in order to increase the sheet feeding amount or distance, a large diameter roller has to be used, which will also result in a problem in reducing the size of the apparatus.

SUMMARY OF THE INVENTION

Accordingly, it is a principal object of the present invention to provide an automatic sheet feeder or a recording apparatus in which the backward tension to the sheet is minimized, and the sheet can still be properly fed in a small size structure.

According to an aspect of the present invention, there is provided an automatic sheet feeding apparatus comprising: sheet supporting means for supporting a sheet; an auxiliary roller for feeding a sheet supported on the sheet supporting means; separating means, having a separation roller and friction separation means, for feeding one-by-one the sheet; feeding means for feeding the sheet separated by the separating means; auxiliary roller moving means for moving the auxiliary roller between an operative position where the auxiliary roller is in contact with the sheet and an inoperative position where it is away therefrom; separation roller moving means for moving the separation roller between an operative position where the separation roller is in contact with the friction separating means and an inoperative position where the separation roller is away therefrom; wherein the auxiliary roller moving means and the separation roller moving means move the auxiliary roller and the separation roller from their operative positions to inoperative positions after the feeding means starts to feed the sheet separated by the separation roller.

According to a further aspect of the present invention, there is provided an automatic sheet feeder comprising: sheet supporting means for supporting a sheet; separation means, having a separation roller and friction separating means, for separating and feeding one-by-one the sheet supported on the sheet supporting means; feeding means for feeding the sheet fed by the separation roller; a stepped portion formed upstream of the separation roller in the sheet supporting means; separation roller moving means for moving the separation roller between an operative position in which the separation roller is in contact with the friction separation means and an inoperative position where the separation roller is away from the friction separation means; wherein the separation roller moving means moves the separation roller from the operative position to the inoperative position after the sheet fed out by the separation roller is started to be fed by the feeding means, and the sheet other than the one fed out is stopped by the stepped portion.

With these structure, the stacked sheet is preliminary separated by the preliminary or auxiliary roller or the stepped portion, so as to effect a certain degree of separation. Thereafter, by the separating roller and the friction separation member, the sheets are assuredly separated one-by-one, and is fed to the recording portion. In this manner, the sheet is assuredly separated by the separation roller. Therefore, even if the separation roller is moved to the inoperative position after the sheet is fed by the feeding means of the recording station, the double feed does not occur.

Thus, when the feeding means of the recording station feeds the sheet, the sheet is separated from the separation roller, and therefore, there occurs no backward tension.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Referring to the accompanying drawings, the embodiments of the present invention will be described.

Figure 1:
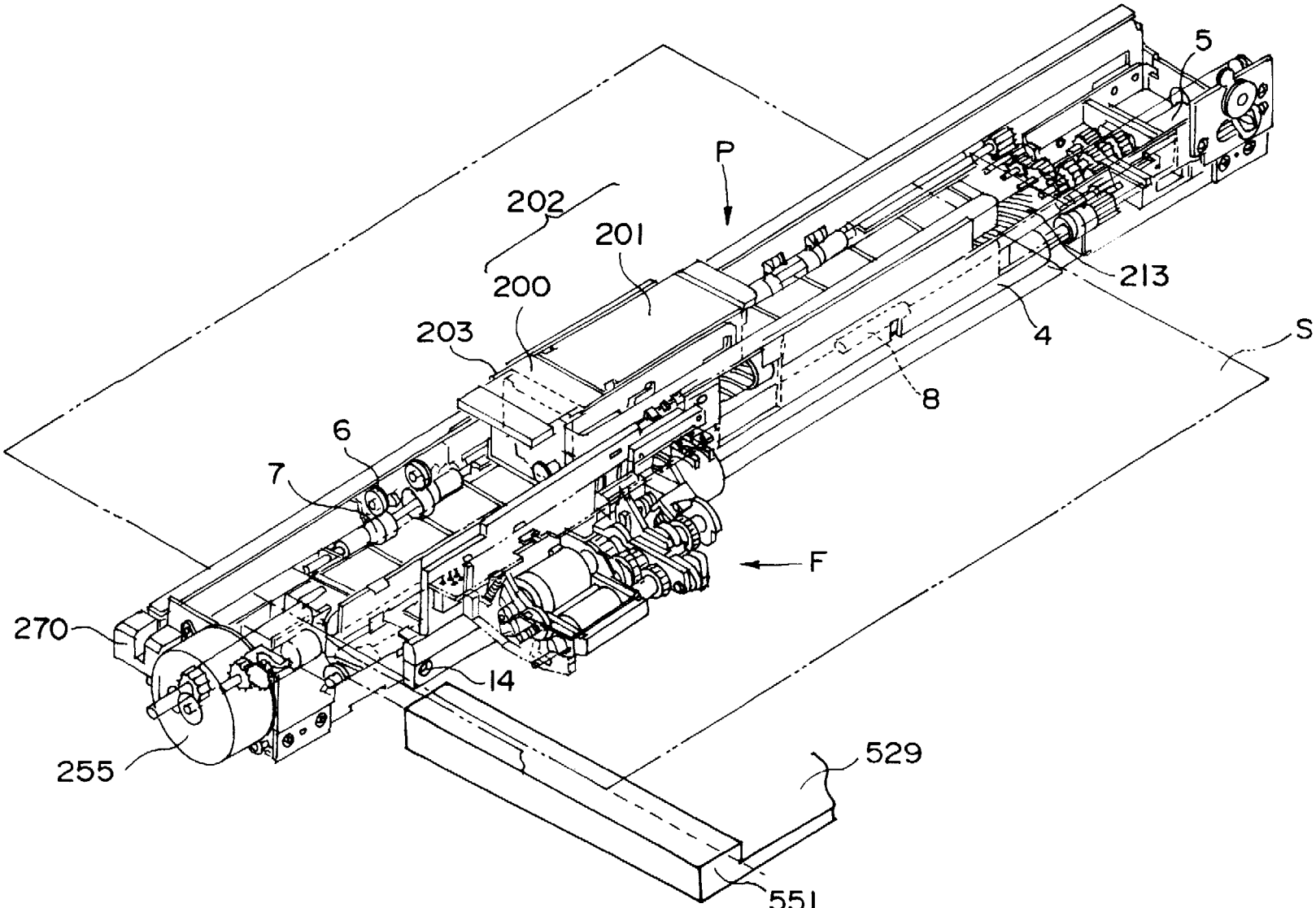
FIG. 1 is a perspective view of an automatic sheet feeder according to an embodiment of the present invention.

Referring to FIG. 1, there is shown in a perspective view an automatic sheet feeder F according to an embodiment of the present invention. The automatic sheet feeder F is fixed in a positional relationship shown in FIG. 1 relative to a printer P.

Figure 2:
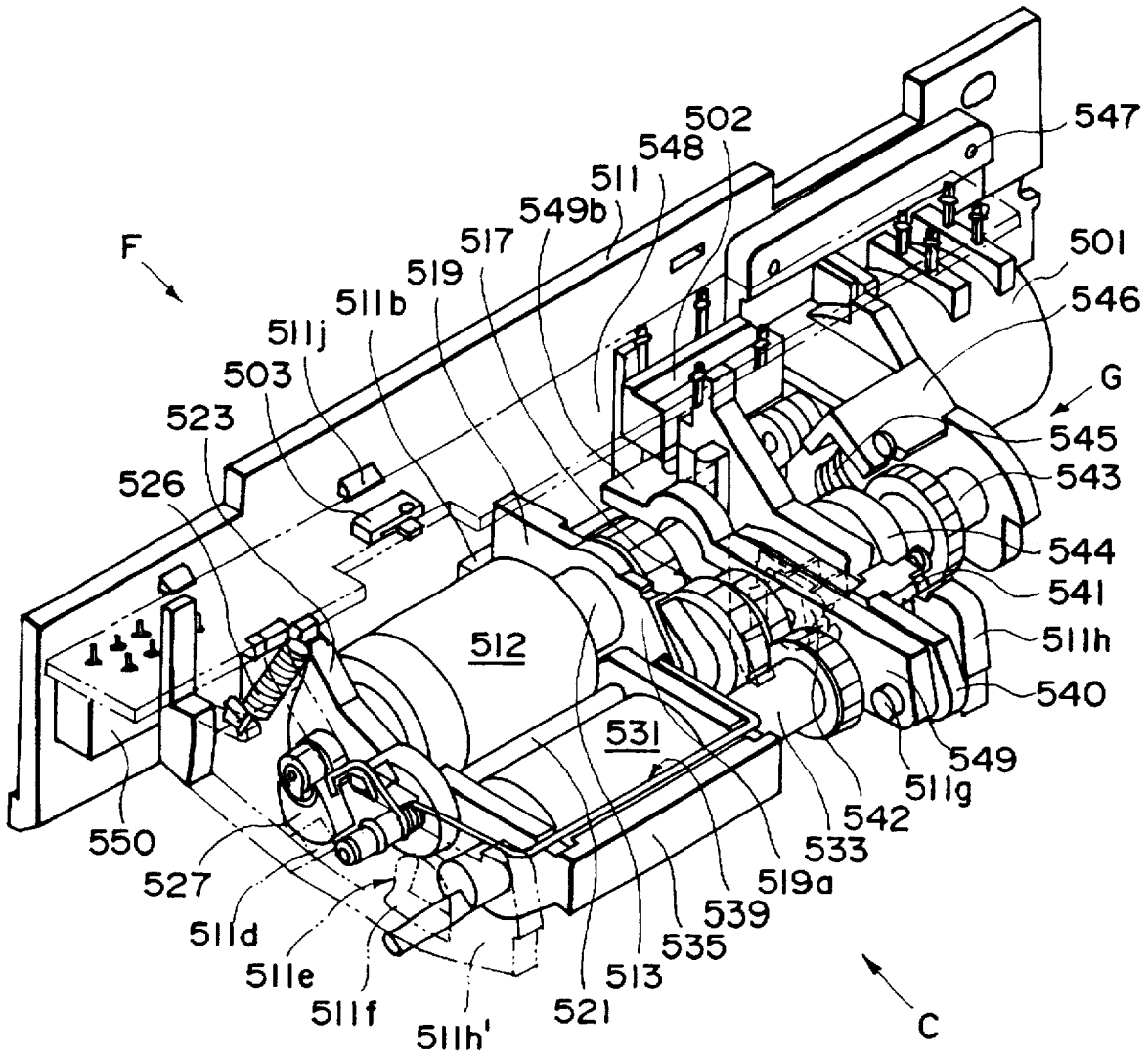
FIG. 2 is a perspective view of an outer appearance of the automatic sheet feeder shown in FIG. 1.
Figure 4:
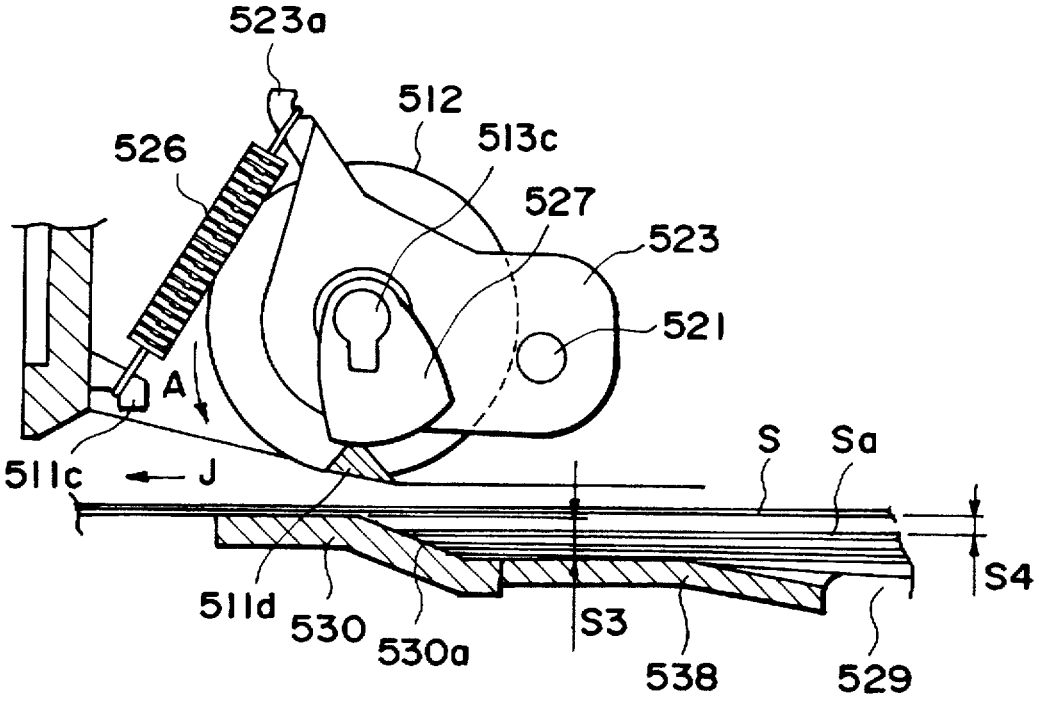
FIG. 4 is a side view of a separation roller used in the sheet feeder shown in FIG. 2.
Figure 5:
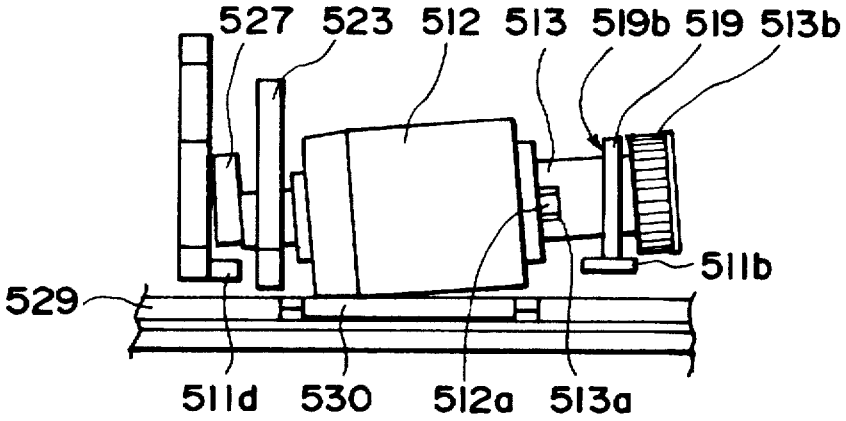
FIG. 5 is a perspective view illustrating a profile of a cam mounted on the separation roller shaft shown in FIG. 2.
Figure 6:
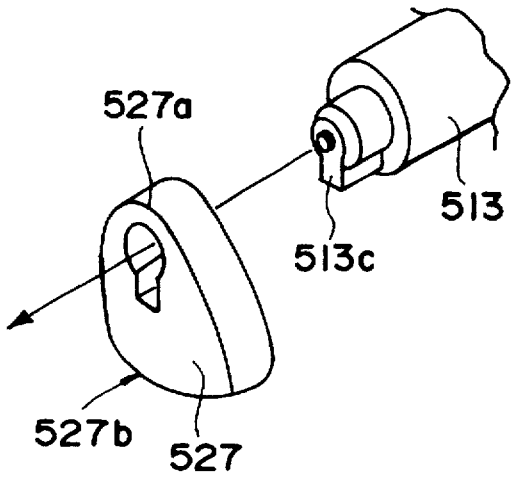
FIG. 6 is a sectional view taken along a line C in FIG. 2.

FIG. 2 is a perspective view of an outer appearance of the automatic sheet feeder F. A main holder 511 supports ultimately all of the parts of the automatic sheet feeder F, and is fixed to the printer P. A separation roller 512 separates the recording sheets one-by-one by its rotation to permit the sheet to be fed to the printer P. As shown in FIGS. 4, 5 and 6, a separation roller shaft 513 penetrates through the separation roller 512 with a projection 512*a* of the separation roller 512 engaged with a recess 513*a* of the separation roller shaft 513, by which, they can be rotated integrally.

An end of the separation roller shaft 513 (right end in FIG. 6) is formed into a gear 513*b*, and the gear 513*b* is in meshing engagement with a first gear 517*a* (FIG. 13) of a clutch gear 517, so that the driving force is transmitted from the clutch gear 517. The gear ratio of the two gears 513*b* and 517*a* is 1:1. When the clutch gear 517 rotates through one full-turn, the gear 513*b* and the separation roller shaft 512 also rotates through one full-turn. The separation roller shaft 513 is engaged with a separation roller shaft holder (R) 519 between the gear 513*b* and the separation roller shaft 512, and it is supported for rotation by bearings 519*b*.

A main shaft 512 is supported by right arm 511*h* and left arm 511*h'* formed on the main holder 511. The separation roller shaft holder (R) 519 is correctly positioned by the main shaft 521 and a projection 511*b* projected from the main holder 511, by which, a bearing member for positioning one end of the separation roller shaft 513 is constituted.

The other end of the separation roller shaft 513 is fixed to a separation roller shaft holder (L) 523. An end of the separation roller shaft holder (L) 523 is journalled on a main shaft 521, and is rotatable up and down about the axis of the main shaft 521. The other end of the separation roller shaft holder (L) 523 is formed into a hook 523*a*, and a separation roller shaft spring 526 is stretched between the hook and a hook 511*c* of the main holder 511, so that the separation roller shaft holder (L) 523 is normally urged in a direction A shown in FIG. 4.

A cam fixing portion 513*c* is projected to the opposite side through the separation roller holder (L) 523, and a separation roller cam 527 is press-fitted into the cam fixing portion 513*c*, so that the separation roller cam 527 rotates integrally with the separation roller shaft 513.

The main holder 511 is provided integrally with a cam receptor 511*d* at a position corresponding to the separation roller cam 527, and the separation roller cam 527 is in sliding contact with the cam receptor 511*d*. In the state shown in FIG. 4, the separation roller cam 527 is in contact with the cam receptor or follower 511*d*, and therefore, the movement in the direction A in FIG. 4, of the separation roller holder (L) 523, is limited.

As shown in FIG. 5, an outer periphery of the separation roller cam 527 is formed into an eccentric shape with different radius from the rotational axis of the cam. When the separation roller shaft 513 rotates, the separation roller holder (L) 523 moves up and down beyond a center which is a main shaft 521, by the distance corresponding to the radius difference of the separation roller cam 527.

When the maximum radius portion 527*b* of the cam is in contact with the cam follower 511*d* of the main holder 511, the other end of the separation roller 512 is away from a friction plate A 530 provided on a sheet feeding guide 529 for supporting the recording sheet (in operative position), thus forming a free sheet passage below the separation roller 512. When the minimum radius portion 527*a* of the cam is in contact with the cam follower 511*d* of the main holder 511, the left end of the separation roller shaft 512 is in contact with the friction plate A 530 of the sheet feeding guide 529 (operative position). At this time, if there is a recording sheet between the separation roller shaft 512 and the friction plate A 530, the recording sheet can be fed toward the sheet feeder of the recording station.

When the sheet is fed by the separation roller 512, the separation roller holder (R) 519 is fixed, and therefore, only the separation roller holder (L) 523 side of the separation roller shaft 512 is displaced, so that only the opposite end of the separation roller 512 is in contact with the friction plate A 530. This will be described, referring to FIG. 5 which illustrates the configuration of the separation roller 512 as seen in the direction of an arrow C in FIG. 2. Such a portion of the separation roller 512 as is contactable to the friction plate A 530 is tapered into a tapered surface 512*b*, as shown in the Figure, so that a point contact does not occur when it is contacted to the friction plate A 530, and in addition, the contact area is increased. By doing so, the initial wearing of the separation roller 512 can be prevented, and since the point contact does not occur, the sheet can be stably caught.

The friction plate A 530 is bent into dull-L-shape, as shown in FIG. 4 to provide a separation slope 530*a* and to provide a step S3 with a friction plate B 538 which will be described hereinafter. The step S3 is effective to improve the separation performance when a plurality of sheets are set.

As shown in FIG. 4, after the sheet S is transferred to the sheet feeder of the recording apparatus, the separation roller 512 may be at its inoperative position. If, at this time, the topmost sheet S moves in a direction J by the sheet feeder of the recording apparatus, a gap S4 is formed between the sheet S and the next sheet Sa, thus preventing the double feed, that is, the simultaneous feed of the sheets Sa and S. In addition, the leading portion of the sheet Sa is prevented from advancing abutment to the separation slope 530*a*, the double feed prevention effect is further enhanced.

Figure 7:
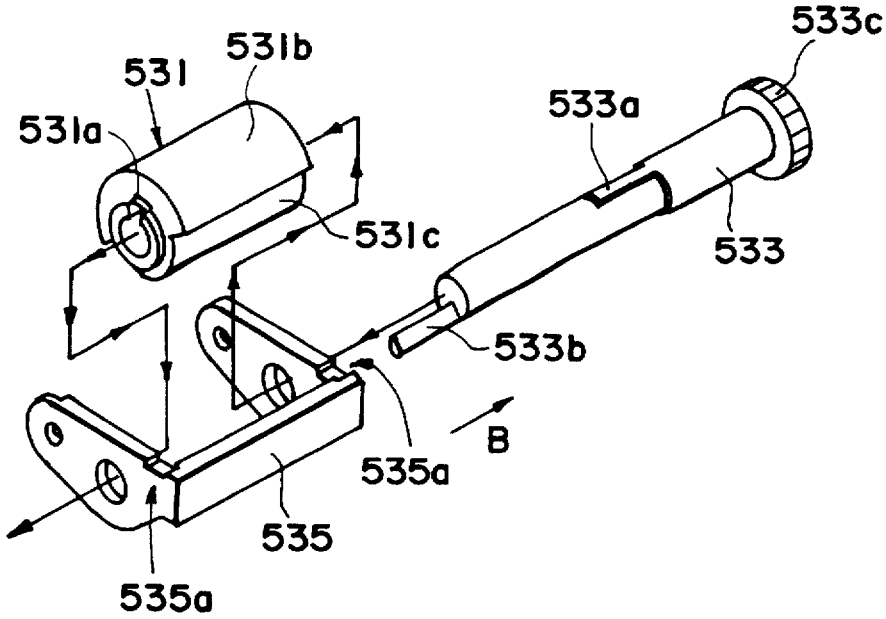
FIG. 7 is an exploded perspective view illustrating mounting of the auxiliary roller in FIG. 2.

As shown in FIG. 7, an auxiliary roller 531 disposed upstream of the separation roller 512 is provided with a sleeve having a key way 531*a* in the inside thereof, and the key way 531*a* and the key 533*a* formed in the auxiliary roller shaft 533 are engaged, so that it is engaged with the auxiliary roller shaft 533. The opposite ends of the shaft 533 are supported by bearings of the auxiliary roller holder 535, and the shaft 533 and the auxiliary roller 531 are integrally rotated.

The auxiliary roller 531 includes a sheet feeding portion 531*b* having a large diameter R1 and a non-sheet-feeding portion 531*c* having a small diameter R2. Normally, the R2 portion 531*c* is faced to the friction plate B 538 under the roller, by which, the sheets can be easily set.

An end of the auxiliary roller holder 535 is engaged with the main shaft 521 (FIG. 8), so that it can freely rotatable in the direction D about the main shaft 521.

The auxiliary roller spring 539 is in the form of a double torsion spring, and the opposite coil portions are engaged to the main shaft and are disposed at the opposite outside of the auxiliary roller holder 535. An end 539*a* of the auxiliary roller spring 539 is engaged to an engaging portion 511*a* of the main holder 511, and the other end is engaged with an engaging portion 519*a* (FIG. 2) of the separation roller shaft holder (R) 519. An operating arm 539*b* of the auxiliary roller spring 539 is engaged with an engaging portion 535*a* of the auxiliary roller holder 535 to provide the clockwise rotation tendency with the auxiliary roller holder 535 in FIG. 8.

Figure 8:
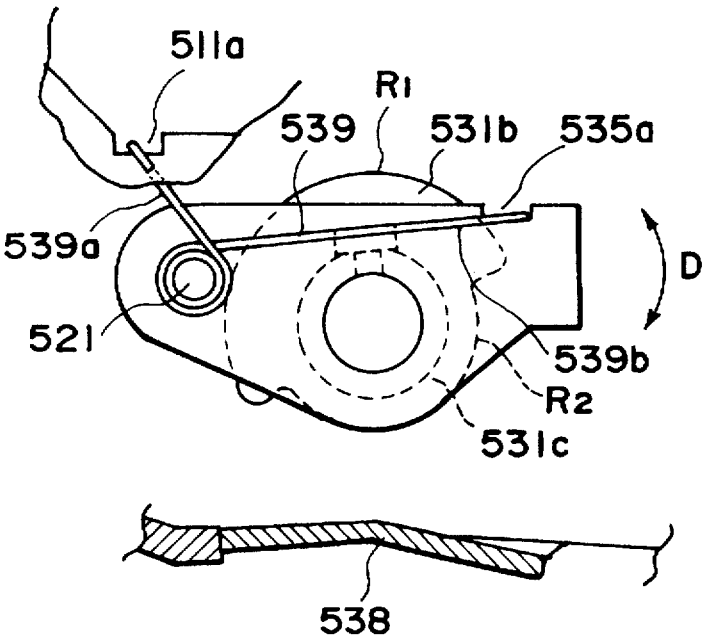
FIG. 8 is a side view of an auxiliary roller shown in FIG. 2.

A cam shaft 533*b* formed at an end of the auxiliary roller shaft 533 is engaged with a deformed hole 511*e* (FIG. 2) formed in the left arm 511*h'* of the main holder 511. The shaft 533*b* is in contact with the bottom edge 511*f* of the hole 511*e*. Together with the action of the auxiliary roller spring 539, it determines the position of the auxiliary roller holder 535 in the direction D (FIG. 8).

A gear 533*c* is formed at a right end of the auxiliary roller shaft 533, and is engaged with a second gear 517*b* (FIG. 13) of the clutch gear 517. The clutch gear 517 rotates on the main shaft 521, and therefore, even if the auxiliary roller holder 533 rotates in the direction D in FIG. 8, the meshing engagement is maintained between the gear 533*c* of the auxiliary roller shaft 533 and the second gear 517*b* of the clutch gear 517. Therefore, the auxiliary roller shaft 533 can always receive the driving force from the clutch gear 517.

The gear ratio of the two gears is 1:1 as in the case of the separation gear, so that one rotation of the clutch gear 517 corresponds to one rotation of the gear 533*c* of the auxiliary roller shaft 533.

Figure 9:
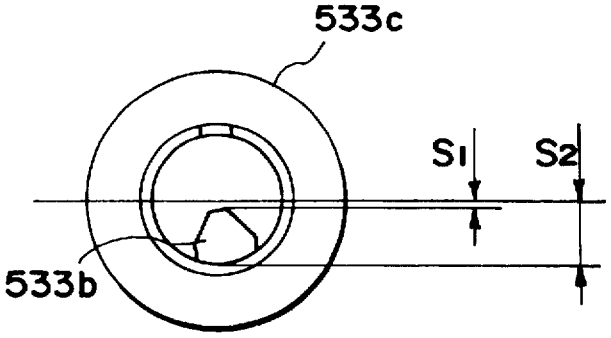
FIG. 9 is a sectional view taken along a line B in FIG. 7.

As shown in FIG. 9 which is a view as seen in a direction B in FIG. 7, the cam profile of the cam shaft 533*b* provided to an end of the auxiliary roller shaft 533 is eccentric. Due to the relation with the bottom edge 511*f* of the deformed hole 511*e* of the main holder 511 to which the cam shaft 533*b* is contacted, it raises the auxiliary roller 531 at the stand-by position. When the sheet feeding portion 531*b* of the auxiliary roller 531 comes to the bottom position, the auxiliary roller 531 is lowered. The number of sheets which can be set between the friction plate B 538 during the stand-by period can be increased by the raising height.

The amount of up and down movements of the auxiliary roller 531 by the cam shaft 533*b* is (S1+S2) in FIG. 9. Therefore, if the radius R1 is increased in FIG. 8, the settable number of sheets is increased. However, the increase of the radius R1 results in increase of the apparatus size. On the other hand, the reduction of the radius R2 is limited from the standpoint of the strength of the apparatus. In view of both aspects, the radii R1 and R2 are properly determined by skilled in the art.

A left guide 511 functions to position the sheet in the lateral direction on the sheet guide 529. In this embodiment, the sheet is supplied to the printer 400 with one lateral side aligned with a reference, and therefore, the guide is provided only at one lateral side.

Figure 3:
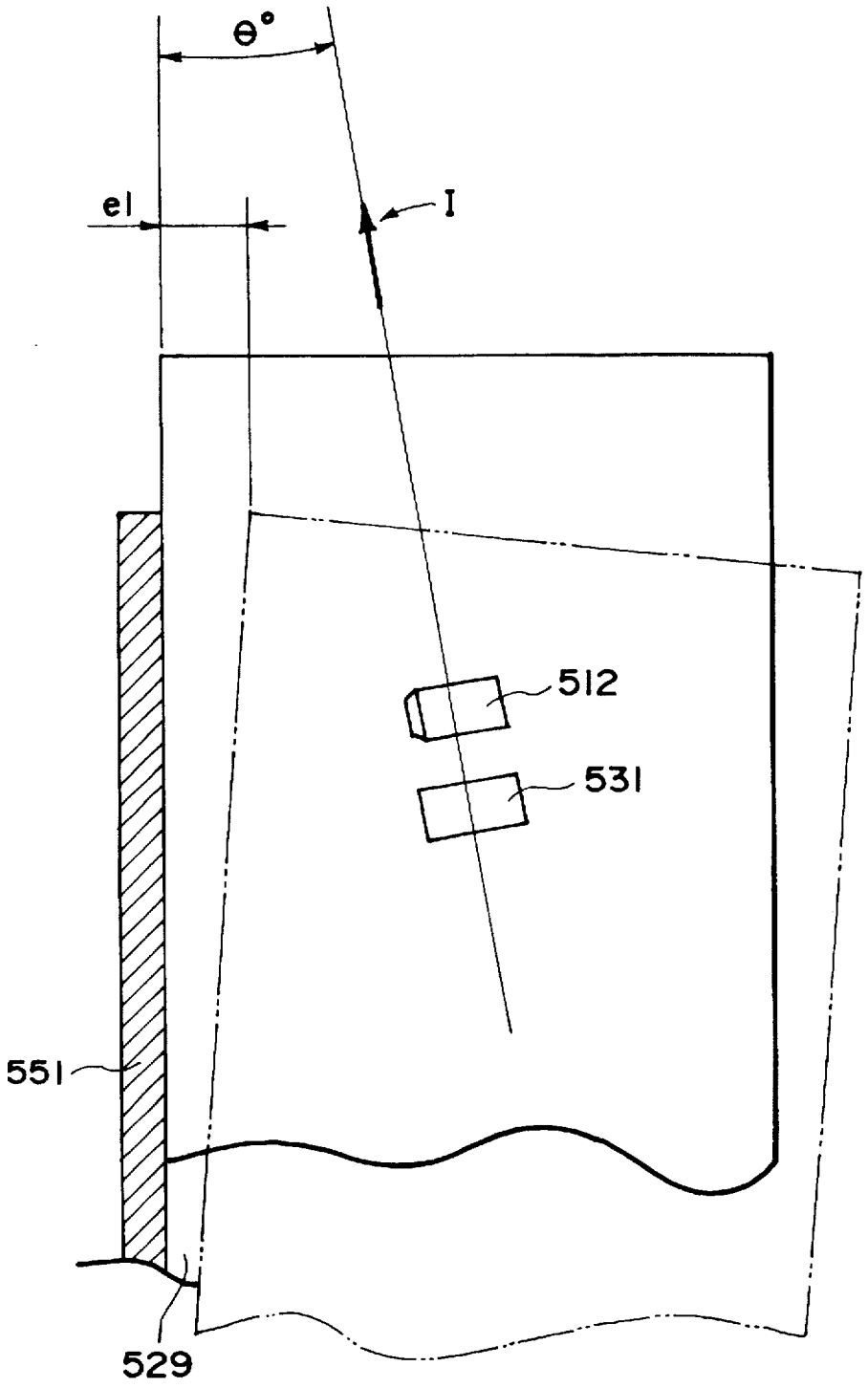
FIG. 3 is a top plan view illustrating feeding of the sheet by the automatic sheet feeder of FIG. 1.

Referring to FIG. 3, the positional relationship between the left guide 511 and the separation roller 512 and the auxiliary roller 531.

FIG. 3 shows a relation between the two rollers 512 and 531 and the left guide 551, in a top plan view of the apparatus.

In the Figure, the sheet driving directions (arrows I) of the two rollers 512 and 531 are inclined by an angle θ relative to the left guide 551. Because of this, even if the sheet initial position setting is not correct, and the leading edge of the sheet is away by e1, for example (broken lines), the sheet can be supplied to the sheet inlet (not shown) of the recording apparatus, while urging the sheet toward the left guide 551 when it is fed by the rollers 512 and 531, and therefore, the sheet can take correct position at said sheet inlet. In this embodiment, θ is 20 minutes–1 degree.

The description will be made as to a sheet stopper 540 for correctly positioning the leading edge of the sheet when the sheet is set on the sheet feeding guide 529. When the operator set the sheets when the rollers 512 and 531 are in the operative position (initial position without contact to the respective friction plates), the sheet stopper 540 function to determine the leading end portion of the sheet. It is engaged with a pivot 511*g* of the main holder 511, and is urged in the direction E in FIG. 10 by a stopper spring 541.

Figure 10:
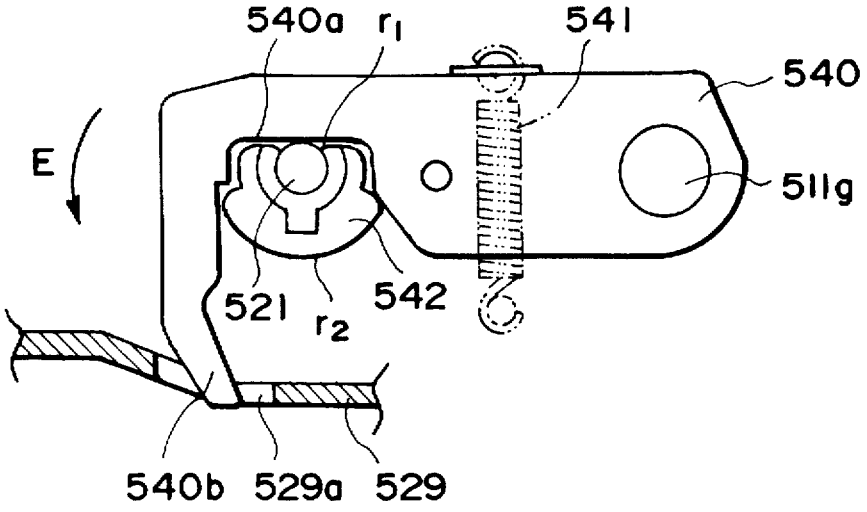
FIG. 10 is a side view illustrating operation of a stopper shown in FIG. 2.

As shown in FIG. 10, the portion facing to the main shaft 521 of the sheet stopper 540, a recess 540*a* in the form of a channel is formed, in which a stopper arm cam 542 rotating on the main shaft 521 is disposed. Normally, at the initial position, the cam follower 540*a* of the sheet stopper 540 and the small diameter portion (r1) of the cam are contacted with each other, by which it is positioned. At this time, the end portion 540*b* of the sheet stopper 540 is received by a hole 529*a* of the sheet guide 529 below the automatic sheet feeder, and therefore, the end portion 540*b* of the sheet stopper 540 limits the sheet inserted along the sheet guide 529, and stops it.

Figure 11:
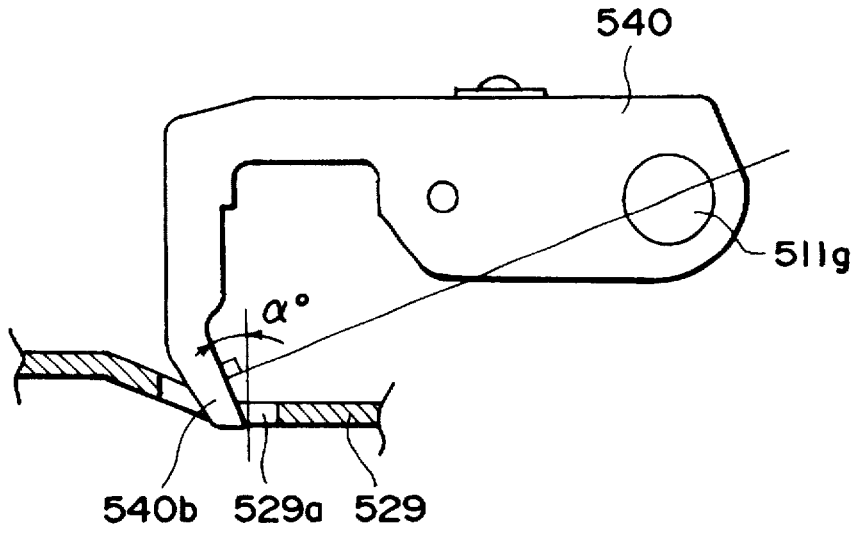
FIG. 11 illustrates configuration of the stopper of FIG. 10.

As shown in FIG. 11, the end portion 540*b* of the sheet stopper 540 is inclined relative to the sheet entering direction at the initial position, by an angle α. This provides a surface substantially perpendicular to the rotational center 511*g* of the sheet stopper 540 to prevent the sheet stopper from receiving the lift relative to the sheet entering direction.

Figure 12:
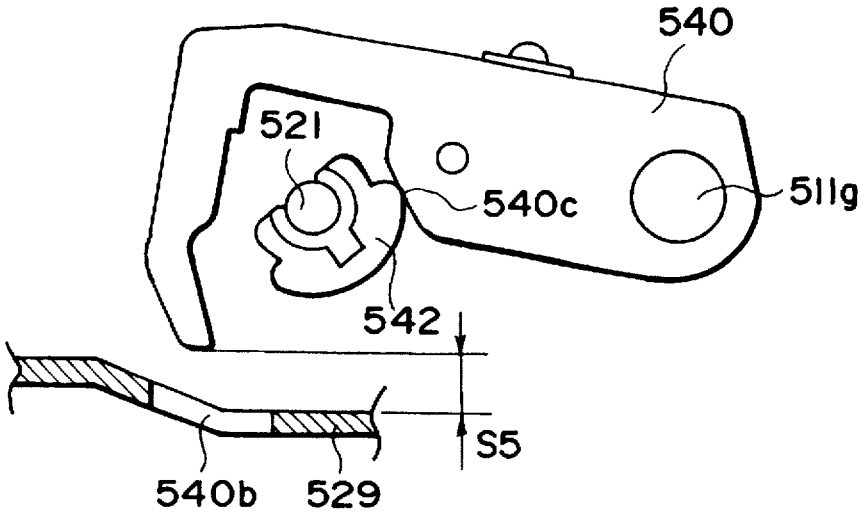
FIG. 12 illustrates the stopper of FIG. 10 in an inoperative position.

By the counter clockwise rotation of the stopper cam 542 from the position shown in FIG. 10 to such an extent that a large radius R2 is in contact with the portion 540*c* of the sheet stopper 540, a gap S5 is provided from the sheet feed guide 529, as shown in FIG. 12, thus providing a sheet path (inoperative position).

Figure 13:
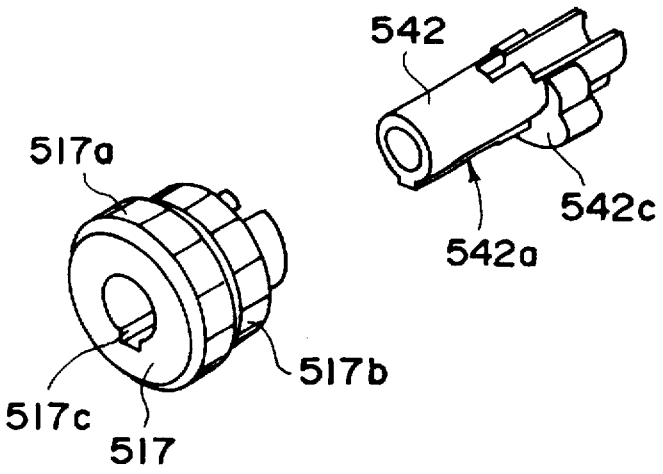
FIG. 13 is an exploded perspective view illustrating connection between a clutch gear and a stopper upper cam shown in FIG. 2.

As shown in FIG. 13, the stopper cam 542 and the clutch gear 517 are made integral by a first key 542*a* and a key way 517*c*. Therefore, when the sheet stopper 540 is in its inoperative position (gap S5), the two rollers 512 and 531 are still in the inoperative positions, and therefore, the sheet can be advanced to the sheet inlet of the recording apparatus beyond the sheet stopper 540. This is a so-called manual feeding mode. In this embodiment, this occurs when the clutch gear 517 rotates through about 30 degrees from the initial state.

The drive transmission to the clutch gear 517 will be described.

Figure 14:
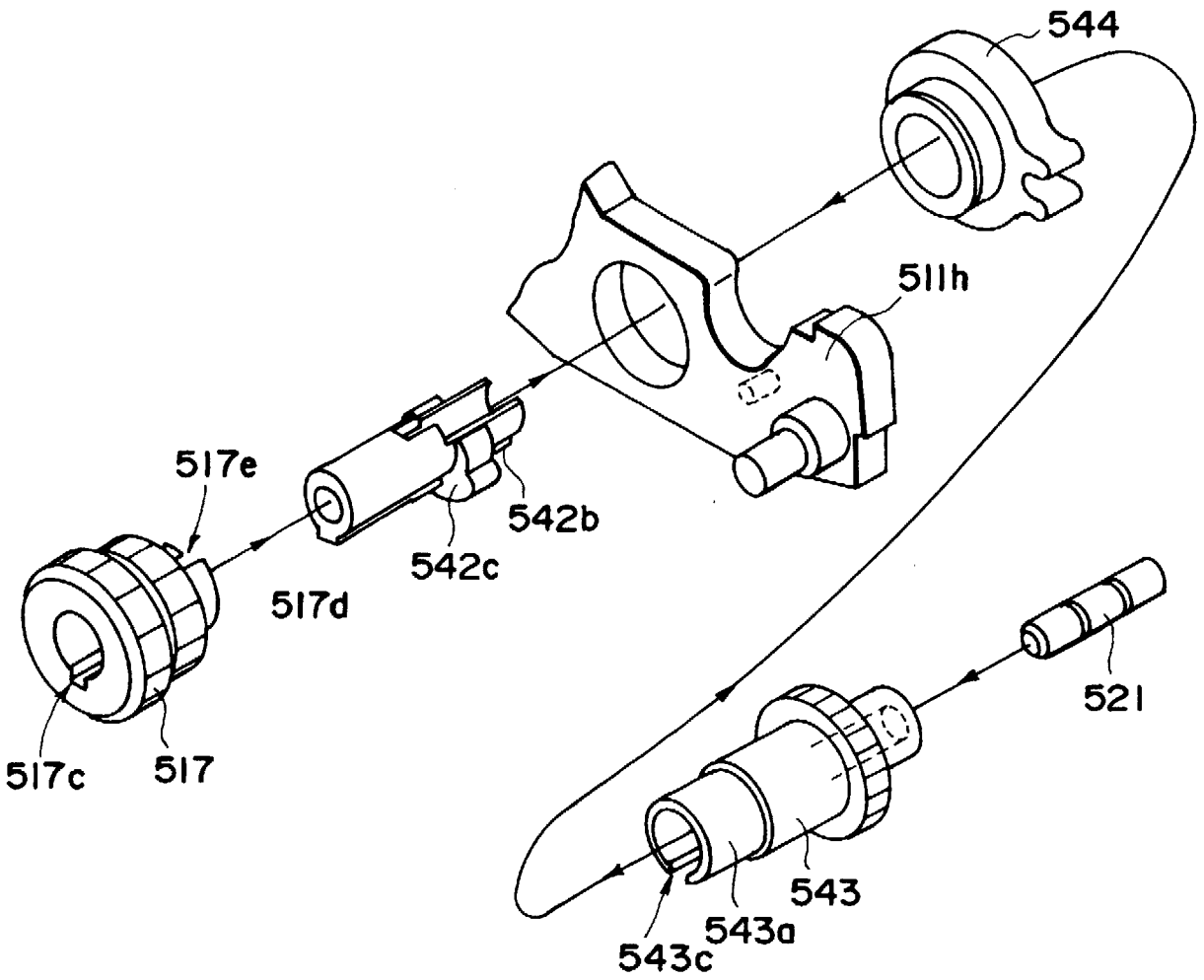
FIG. 14 is an exploded perspective view illustrating connection between an output gear and a clutch gear shown in FIG. 2.

As described hereinbefore, the clutch gear 517 is engaged with a stopper cam 542 by key 542*a* and key way 517*c*. As regards the stopper cam 542, the key way 543*c* of the output gear 543 and the second key 542*b* are engaged at the opposite side from the side of the engagement with the clutch gear 517, as shown in FIG. 14. A bearing 544 is set in a predetermined hole of the right arm 511*h* of the main holder 511 to support a portion 543*a* of the output gear 543.

The above parts are coaxially disposed with the main shaft 521, and the rotation of the output gear 543 is transmitted to the clutch gear 517 through the stop cam 542, and further to the separation roller shaft 513 and the auxiliary roller shaft 533.

Figure 15:
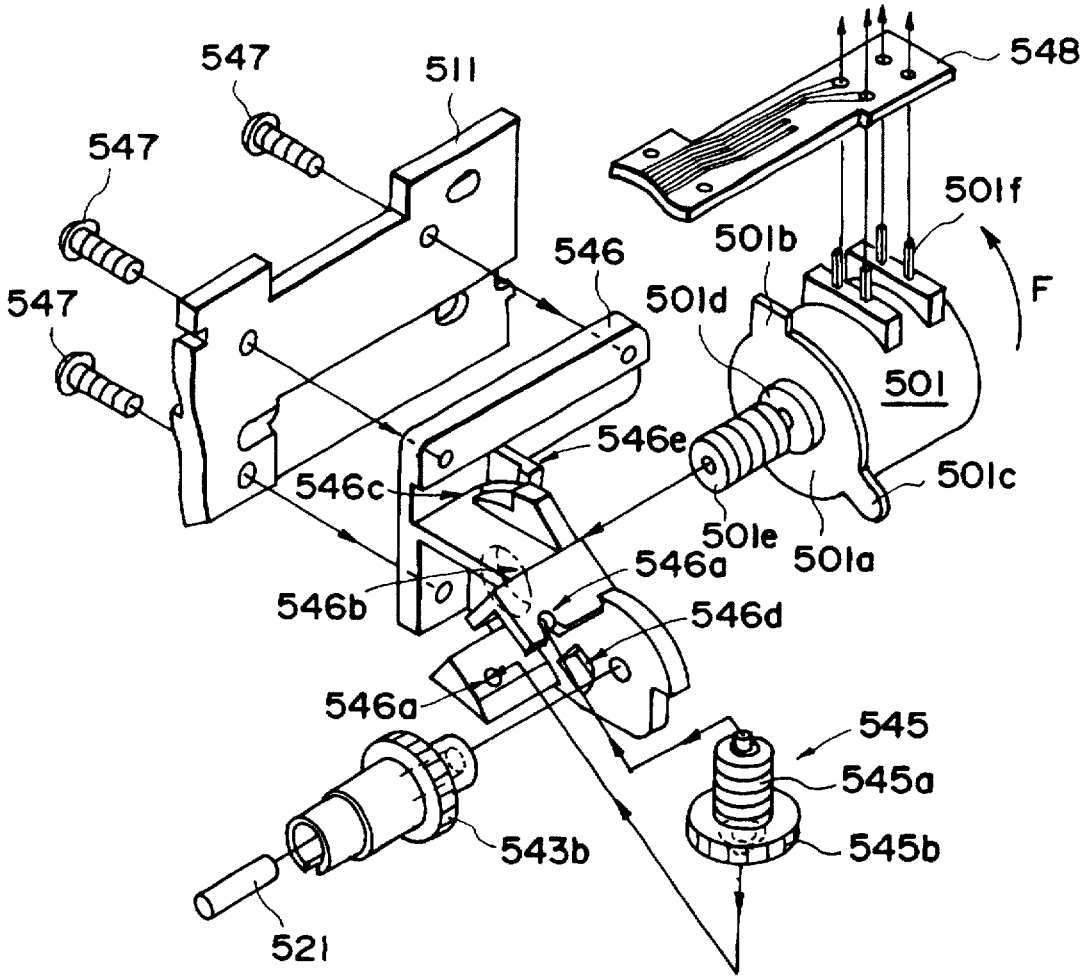
FIG. 15 is an exploded perspective view illustrating mounting of an automatic sheet feeding motor of FIG. 2.

As shown in FIG. 15, the output gear 543 is provided with a helical gear 543*b* which is meshed with a warm gear 545*a* of the double gear 545 to transmit the rotation from the double gear 545. The double gear 545 is engaged with a hole 546*a* (upper and lower ones) of the motor bracket 546, so that it is freely rotatable about the hole 546*a*.

A mounting flange 501*a* of the automatic sheet feeding motor 501 is provided with two projections 501*b* and 501*c* and a metal portion 501*d*, which are respectively engaged with a metal reception hole 546*b*, engaging portions 546*c* and 546*d* of a motor bracket 546. Particularly, the projection 501*b* and the engaging portion 546*c* is engaged beyond a pawl 546*e* by rotation of the motor in the direction F about the metal portion 501*d* and the metal receptor hole 546*b*, by which the motor bracket 546 and the motor 501 are correctly positioned. The motor bracket 546 is fixed on the main holder 511 by three screws 547.

At this time, four contacts 501*f* of the motor 501 face the base plate 548. At an end of the output shaft of the motor 501, there is provided a motor pinion 501*e* in the form of a warm gear, which is in meshing engagement with the helical gear 545*b* of the double gear 545, thus transmitting the driving force from the motor 501.

The motor 501 is in the form of a pulse motor of two phase excitation type and bipolar drive type. It rotates through one full-turn by 20 steps. The total reduction gear ratio from the motor 501 to the clutch gear 517 is 1:256.

The description will be made as to the detection of the initial position (home position) of the automatic sheet feeder F. As shown in FIG. 14, the clutch gear 517 is engaged with the stopper cam 542, and is provided with an initial position detecting cam 517*d* next to the left side of the cam portion 542*c* of the stopper cam 542. The cam portion 517*d* of the clutch gear 517 is provided with a groove 517*e* for the initial position detection at a position opposite from the key way 517*c*.

Figure 16:
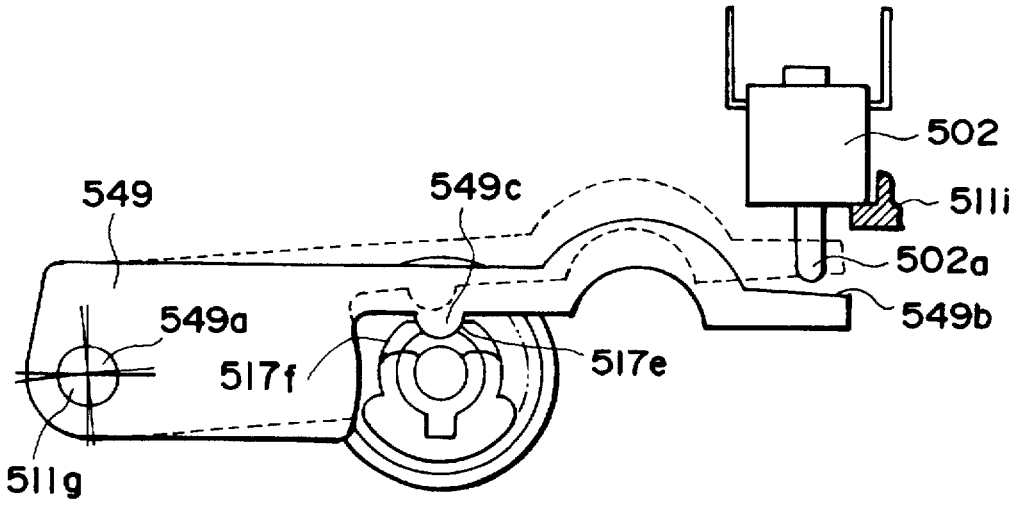
FIG. 16 is a sectional view taken along a line G in FIG. 2.

FIG. 16 is a sectional view as seen in a direction G in FIG. 2.

As shown in FIG. 2, an initial lever 549 for the initial position detection is disposed to the left side of the sheet topper 540.

The initial lever 540 is rotatably engaged with the rotatable shaft 511*g* of the main holder 511. At an opposite side relative to the rotational center 549*a* of the initial lever 549, an acting portion 549*b* in the form of a plate is provided to push an actuator 502*a* of a sensor switch 502 on the base plate 548. In addition, between the rotational center 549*a* and an acting portion 549*b*, a follower portion 549*c* tracing the cam portion 517*d* is provided. With this structure, when the follower 549*c* of the initial lever is caught by the detection groove 517*e* of the clutch gear 517 (solid line state in FIG. 16), the switch 502 produces on-signal.

When the follower 549*c* is on the outer peripheral portion 517*f* of the cam 517*d* (broken line position in FIG. 16), the actuator 502*a* of the switch 502 is pushed, and therefore, off-signal is produced. In this manner, the initial position of the apparatus is determined on the basis of the on-signal of the sensor switch 502.

Here, the positional relation with the initial lever 549 of the sensor 502, is correctly determined to avoid erroneous detection. In this embodiment, the main holder 511 is provided with an abutment 511*i* (FIG. 16) for the positioning of the sensor 502, and a base plate 548 supporting the sensor 502 is deflected so that the outer peripheral of the sensor 502 is abutted to the abutment, thus providing the correct positioning. The main holder 511 is provided with a base plate confining portion 511*j* (FIG. 2) for deflecting the base plate 548.

The description will be made as to the switching between the automatic sheet feed mode and manual sheet feed mode.

The switching is effected in response to a switching signal of the sheet feed switch 503 in the form of a slide switch. In this embodiment, when the switch 503 is in the off-state, the mode is the automatic feeding mode. When it is in the on-state, it is the manual mode. To the left end of the base plate 548, a connector 550 is provided (FIG. 2) to effect the motor driving electric energy supply from an unshown external circuit and/or an output of a signal of the sensor switch 502 and the sheet feed mode switch 503.

The printer P will be described.

Figure 24:
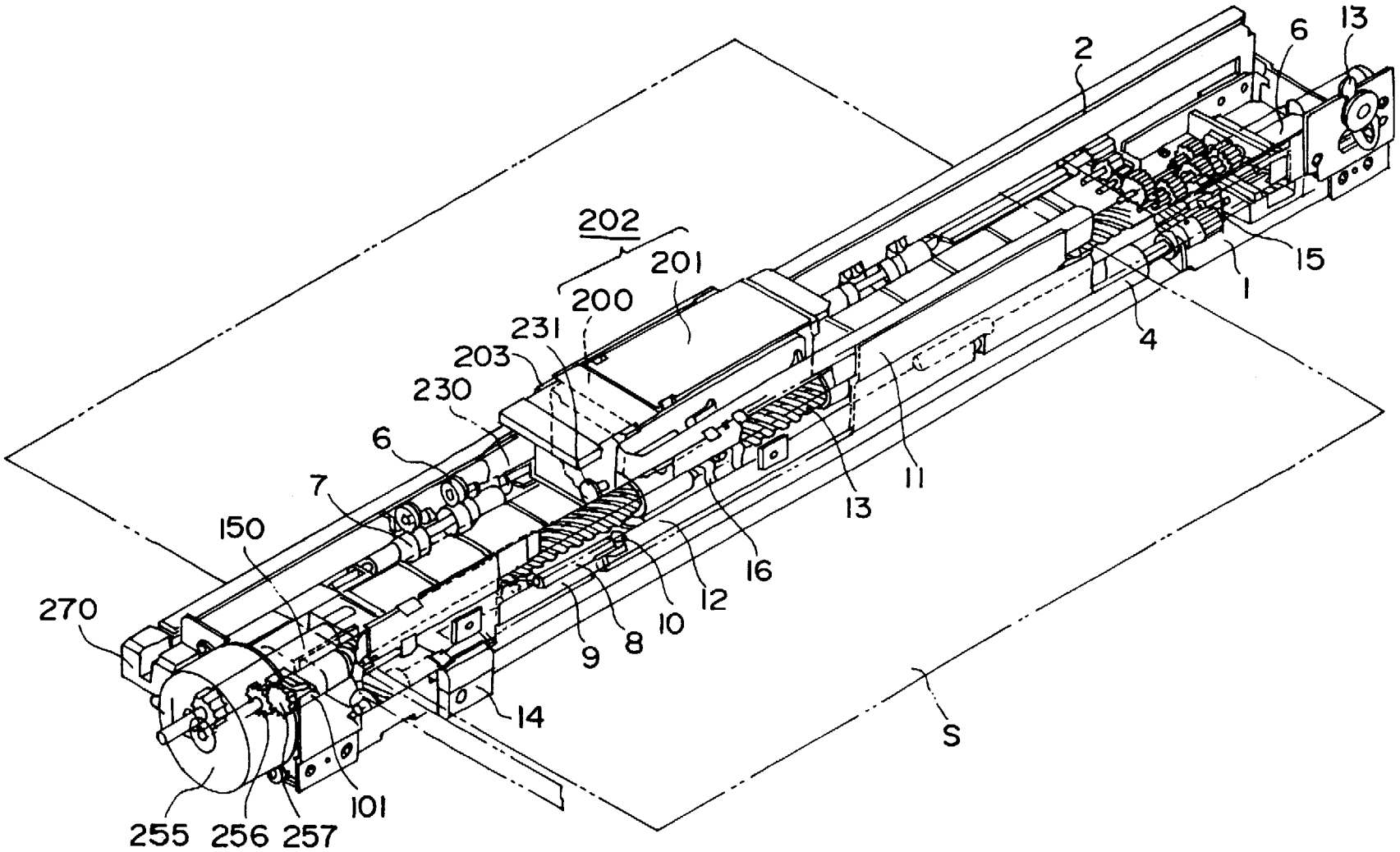
FIG. 24 is a perspective view of a recorder shown in FIG. 1.

FIG. 24 is a perspective view of a printer portion P.

A carriage 203 carries a head cartridge 202 comprising a recording head 200 constituting recording means and an integral ink container 201. An end of the carriage 203 adjacent the recording head 200 carried thereon, is slidably engaged with a lead screw 213 which is rotatably mounted on a frame 1. Adjacent the other end of the carriage 203, there is a guide, and the guide is slidably engaged with a guide rail 2 of the frame 1 for movement in the direction of the length of the lead screw 213. The carriage 213 is thus reciprocable by the rotation of the lead screw 213 in the longitudinal direction thereof while the position of the carriage 203 maintained constant.

As shown in the Figure, a lead screw gear 257 fixed to the left end of the screw, and the pinion gear 256 fixed to the output shaft of the carriage motor 255, are in meshing engagement with each other. An unshown guiding lead helically formed at a predetermined pitch on the lead screw 213 is engaged by a lead pin (not shown) fixed to the carriage 203. Therefore, by the forward and backward rotation of the carriage motor 255, and therefore, by the rotation of the lead screw 213, the carriage 203 reciprocates.

Designated by a reference numeral 211 is a flexible cable which functions to transmit the printing signal to the recording head 200 from an electric circuit which will be described hereinafter, and is positioned and supported by a flexible cable holder 16 on a pinch roller frame 11. In synchronism with the reciprocal movement of the carriage 203, the recording head 200 is driven to eject the ink in accordance with the recording signal, by which, one line recording is effected on the recording material 3. The recording head 200 comprises a fine liquid ejection outlet (orifice), a liquid passage, an energy applying chamber in a part of the liquid passage, and energy generating means for generating energy contributable to the ejection of the liquid in the energy acting chamber.

The energy generating means may be a piezoelectric element, electromagnetic wave such as laser to heat the liquid to eject it, an electrothermal transducer in the form of a heat generating resistor to heat the liquid to eject the liquid.

Among them the thermal energy type ink jet recording head is preferable because the liquid ejection outlets for ejecting droplet of liquid can be arranged at high density, and therefore, a high resolution recording is possible. Particularly, a electrothermal transducer is preferable as the energy generating means, because the size of the apparatus can be reduced, semiconductor manufacturing technology or micro-machining technology can be used to the good advantages, and because high density arrangement is possible with low manufacturing cost.

After completion of one line recording by the scanning operation of the carriage 203, the sheet 5 is fed by one line by feeding means, and the next line recording operation is carried out. The feeding of the sheet S is effected by a feeding roller 4 and a pinch roller 8 press-contacted thereto and by a discharging roller 7 and a spur 6 contacted thereto.

Figure 25:
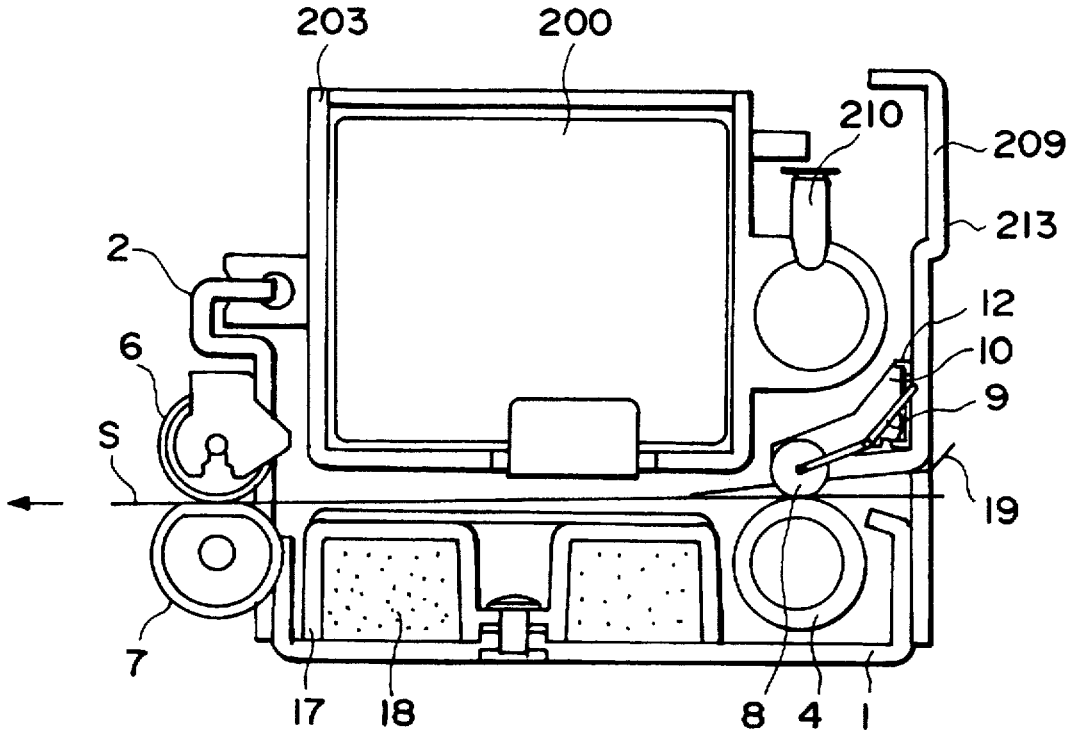
FIG. 25 is a longitudinal sectional view of a sheet feeder portion in the recorder shown in FIG. 24.

Referring to FIG. 25 which is a sectional view of a sheet feeding mechanism, a recording sheet S faced to the ejection outlet side of the recording head 200 is nipped between the feeding roller 4 and the pinch roller 8, and the feeding roller 4 is rotated by a sheet feeding roller 5, by which the sheet is fed through a proper distance. After the recording, the sheet S is press-contacted to the discharging roller 7 by the spur 6, and the sheet is discharged to the output of the apparatus by the rotation of the discharging roller 7.

Designated by a reference numeral 17 is a platen which also functions as a casing of a discharging ink absorbing material 18. A confining plate 19 (not shown in FIG. 24) is of thin elastic material such as polyester sheet or stainless steel, and is bonded to a pinch roller frame 11. It functions to prevent the sheet S moving away from a sheet conveying path connecting the spur 6 and the feeding roller 4. Since it is integrally extended from sheet inlet of the printer unit, it can properly guide the sheet from the sheet inlet to the recording portion. As shown in the Figure, it is bent upwardly at the inlet portion to facilitate entrance of the sheet thereinto. The feeding roller 4 and the discharging roller are driven by the sheet feeding motor 5, and the guiding force is transmitted through a reduction gear train 15.

The position of the rotation shaft of the spur or spurs 6 contactable to the record side of the sheet S is fixed, and therefore, the contact position between the spur 6 and the sheet S does not change irrespective of the thickness of the sheet S. However, the discharging roller 7 contactable to the non-record side of the sheet S deforms corresponding to the thickness of the sheet S, more particularly the discharging roller 7 is made of small thickness rubber and is formed generally into a cone. It elastically deforms in the radial direction, and therefore, it elastically deforms in accordance with the press-contact force to the spur 6 and the thickness of the sheet S.

Figure 26:
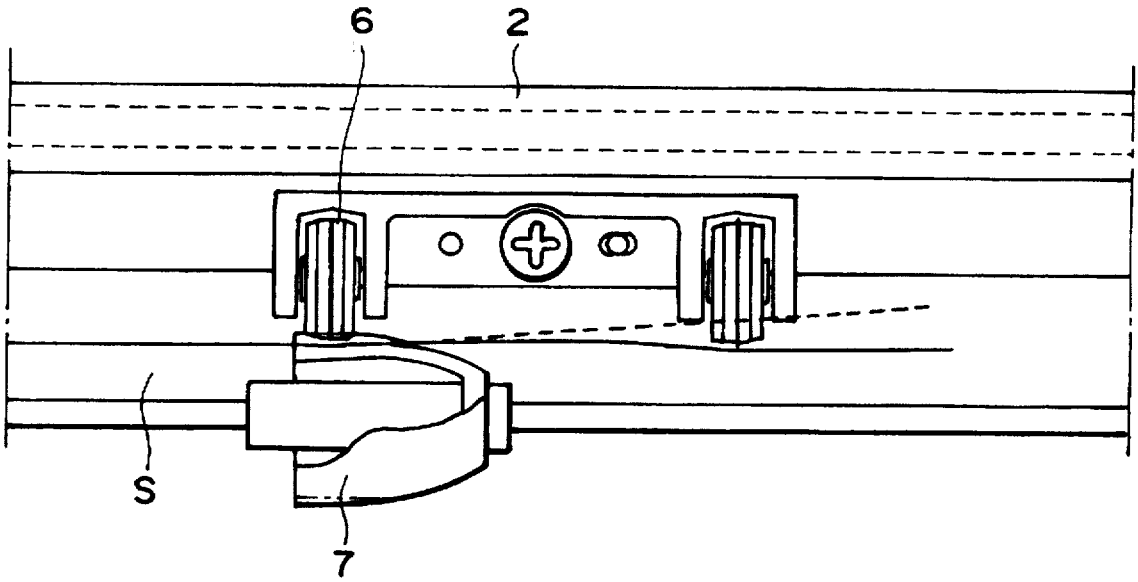
FIG. 26 is a view of a sheet discharging roller of the recorder of FIG. 24, as seen from the sheet discharging direction.
Figure 27:
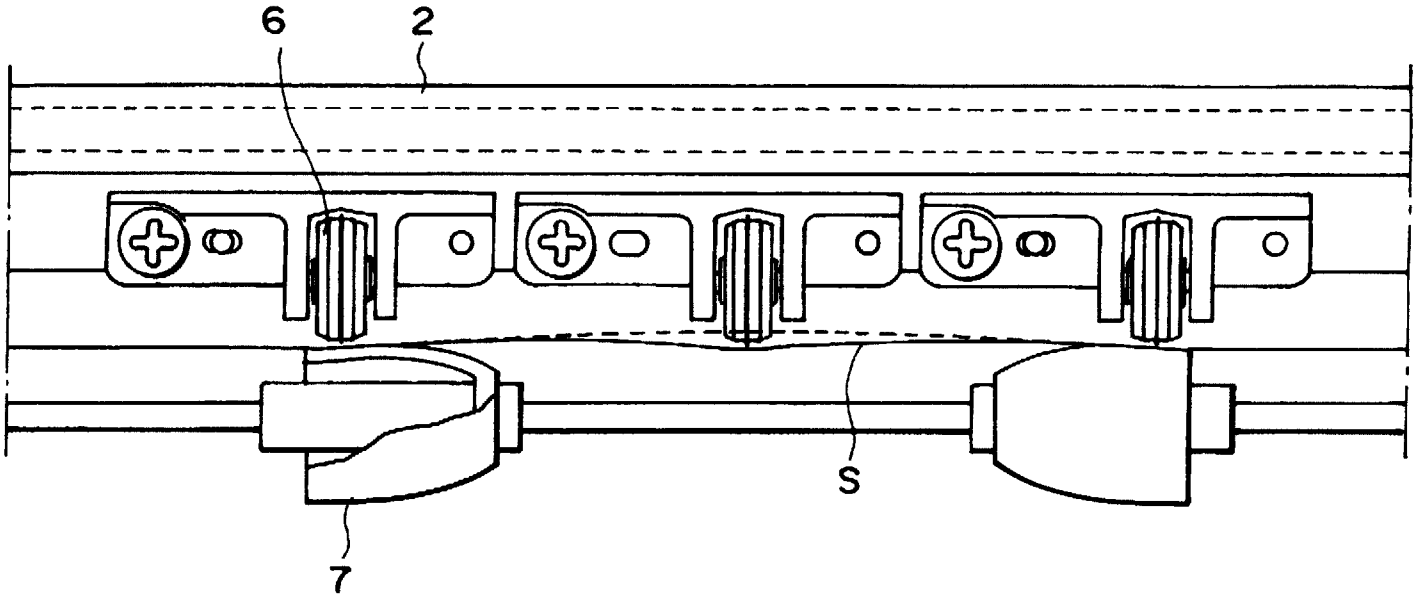
FIG. 27 illustrates sheet discharging rollers according to another embodiment of the present invention.

Referring to FIG. 26, there is shown an improved discharging roller, as seen from the discharging direction. First, a portion engaging with the discharging roller supporting shaft is projected beyond each of the opposite ends of the cone shape. By doing so, when the discharging roller is press-fitted to the discharging roller supporting shaft, the assembling operation is made easier, since the shaft portion can be pushed irrespective of the orientation of the cone-like member.

As shown in the Figure, when the discharging roller is press-contacted to the spur, it deforms such that a rotation occurs about the contact portion between the shaft and the cone. Therefore, the sheet S tends to rise as shown by the broken line in the Figure. Therefore, one spur is added to provide a structure using one discharging roller and two spurs, the sheet can be maintained at correct position.

In this case, it seems that the portion contacted by the spur is made part conical so as to be horizontal when contacted by the spur. However, if this is done, the peripheral circumferential length of the discharging roller changes depending on the position where it is contacted to the spur, and therefore, the moving distance is different depending on the individual discharging roller because of the variation in the longitudinal position. This is not preferable.

Figure 28:
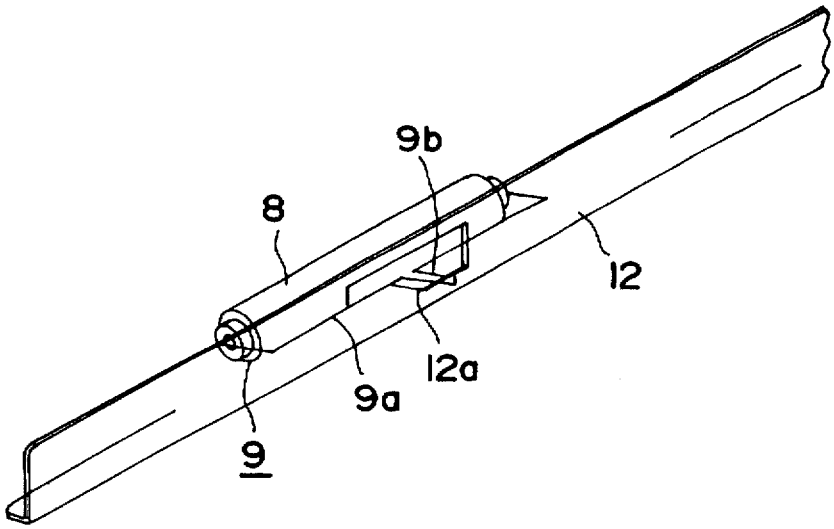
FIG. 28 is a perspective view showing a releasing state of a pinch roller in the recorder of FIG. 24.

FIG. 28 shows another structure in which two discharging roller are arranged so that cylindrical portions thereof are at the outside, and a spur is added between the spurs opposed to the discharging rollers. The same advantageous effects as in FIG. 26 can be provided by the combination of two discharging rollers and three spurs. In addition, the same advantageous effects can be provided if the discharging roller 7 is made of exhibiting large elastic deformation, for example, porous sponge or resin or rubber having very low hardness. In addition, the entirety of the discharging roller 7 can be press-contacted to the spur 6 by spring or the like. The gap between the recording head 200 and the sheet S can be maintained constant irrespective of the thickness of the recording material 3, and therefore, the feeding operation is stabilized. A paper sensor 14 functions to detect the presence or absence of the sheet S.

Referring to FIG. 28, the description will be made as to the pinch roller 8 which is a follower rotatable member for pressing the sheet S to the discharging roller 4 which is a driving rotatable member. The pinch roller 8 is integrally molded. A bent end of the pinch roller spring 9 which is a spring member is inserted thereinto, so that it is supported properly. The pinch roller spring 9 is supported for rotation about a shaft 9*a* by a pinch roller holder 10 on the pinch roller frame 11. The shaft 9*a* of the pinch roller spring 9 is bent into U-shape at the central portion to constitute a lever portion 9*b*.

As for the operating means for changing the pressure of the pinch roller spring 9 to the pinch roller 8, a slidable release angle 12 is overlaid on the pinch roller frame 11. The pinch roller spring 9 is raised by operating the angle to twist the shaft 9*a*. By the repelling force, the pinch roller 8 is urged to the feeding roller 4. By removing the twist, the pressure force is removed.

Figure 29:
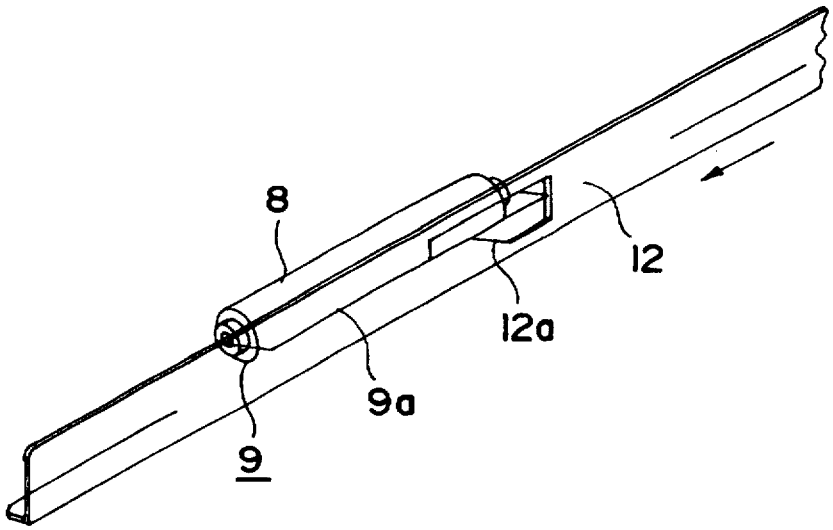
FIG. 29 is a perspective view illustrating the pinch roller in the press-contact state in the recorder of FIG. 24.

More particularly, in FIG. 29 state, the lever 9*b* is urged by a cam 21*a* mounted to the release angle 12, by which the shaft is twisted (elastic deformation), so that the pinch roller 8 is urged to the feeding roller 4. On the other hand, when the release angle 12 slides in the direction indicated by an arrow in FIG. 29, the state of FIG. 28 is established. Then, the cam 12*a* lowers, and the lever of the pinch roller 8 lowers. By this, the shaft 9*a* restores, and the twist is removed, by which the urging force of the pinch roller 8 to the feeding roller 4 decreases.

Figures 30A, 30B, 30C:
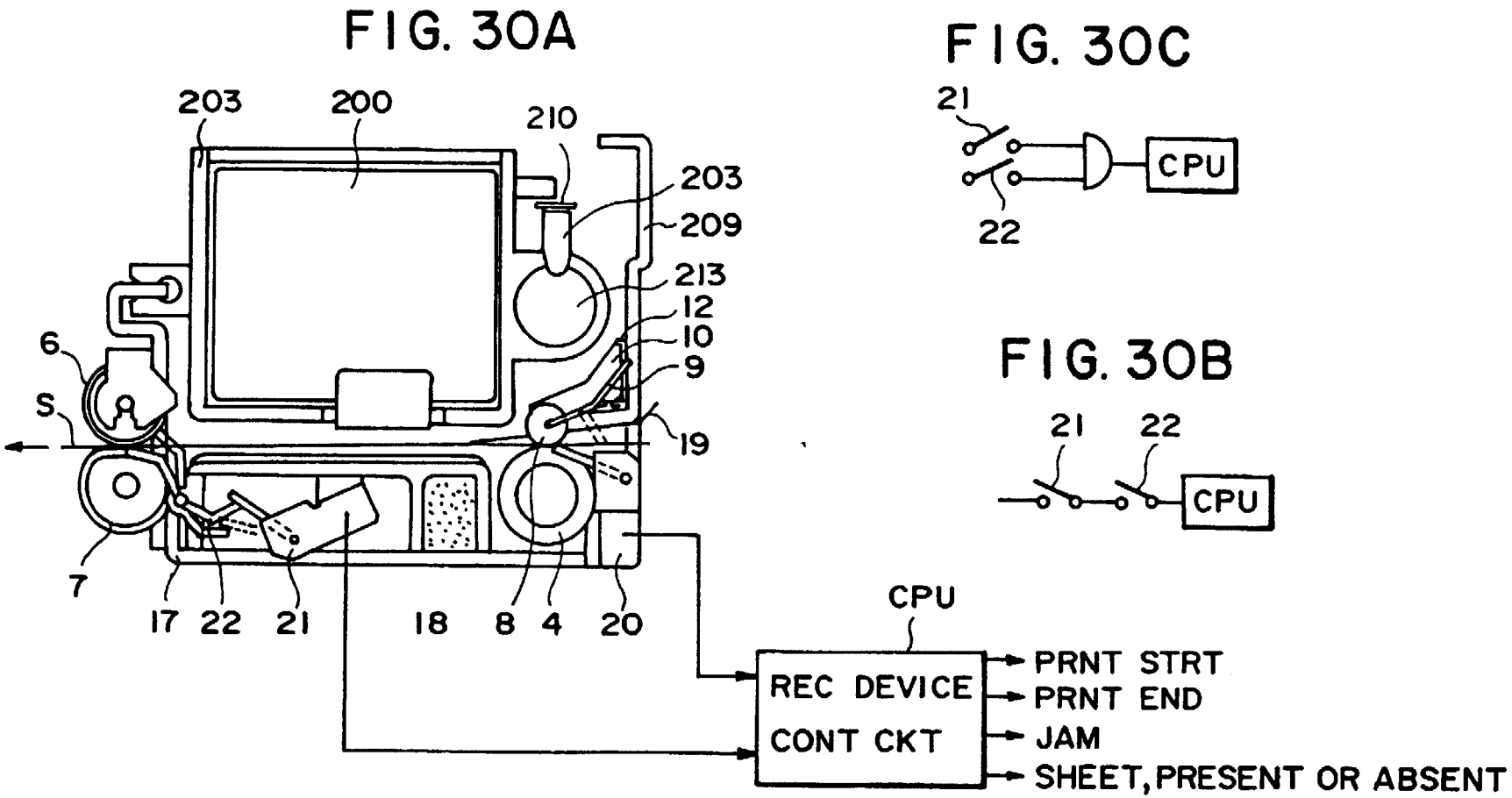
FIG. 30 is a longitudinal sectional view illustrating arrangements of various sensors in the sheet feeding portion in recorder of FIG. 24.

Then, a jammed sheet S can be easily taken out even if the pinch roller 8 is not completely away from the feeding roller 4. The left and right sliding of the release angle 12 can be accomplished by rotating the release lever 13. The release lever 13 is journaled on the pinch roller frame, and an elongated slot is formed at a side across the rotational shaft therefrom. The elongated hole receives a grip of the release angle 12. By rotating the release lever 13, the release angle 12 makes a translational motion. FIG. 30 is a sectional view of the apparatus including the sensor.

Designated by a reference numeral 20 is a sheet detecting sensor at the sheet inlet, and 21 is a sheet detecting sensor at the sheet outlet. In this embodiment, the sensor themselves are the same. If there is a sheet S, the lever is pushed so that electric contacts in the sensor are contacted to establish a contact state, thus detecting the presence of the sheet S.

In the Figure, the lever position without the sheet S is indicated by chain lines. At the inlet side, the sheet S directly pushes the sensor lever. However, the output, the sheet discharging roller at the non-record side deforms in accordance with the thickness of the sheet, and therefore, the height is not enough to mount the sensor as contrasted to the inlet side, and therefore, another lever 22 is used.

When the size of the sensor is sufficiently small, the lever is not necessarily used at the outlet side. In either case, the lever contactable to the sheet S does not project into the sheet discharge side beyond the discharging roller 7. It is as downstream as possible. If an end of the lever projects beyond it, even if the sheet S is being discharged from the apparatus, the trailing end portion of the sheet S lowers the rear end of the lever, so that the sensor detects the presence of the sheet. The downstream arrangement is preferable since then it is assured that the leading edge of the sheet S is between the spur 6 and the discharging roller 7.

The recording operation is started after the outlet sheet sensor 21 detects the presence of the sheet S. After the inlet sheet sensor 20 detects absence of the sheet S, that is, after the trailing edge of the sheet S passes by the sensor, the recording operation is stopped. By doing so, the recording operation can be prevented when the sheet S is not present at the recording position, or when the pinch roller 8 does not properly hold the sheet S or does not properly feed it.

When the sensor uses electric switch actuated when the sheet S is detected, the two sensors may be connected in series (FIG. 30 (B)), and that is enough to function the same effect. In other words, when the sensor is connected in series, the electric circuit of the recording apparatus or printer discriminates the presence of the sheet S only when both of the sensors are in the closed state.

When the sheet S is loaded, the sheet presence is detected only at the arrival of the leading edge of the sheet S at the outlet sheet detecting sensor 21. The sheet absence is detected only by passage of the trailing edge by the inlet sheet detecting sensor 20. The electric circuit of the recording apparatus may deem them as a single sensor. If it is not possible to connect them in series, the two sheet detecting sensors may be connected through an AND circuit (FIG. 47 (C)), and then they may be deemed as a single sensor.

When the two sensors are used separately, it is possible to start the recording operation immediately after the leading edge of the sheet. For example, the leading edge of the recording sheet 3 loaded is fed to the outlet sheet sensor 21 position, and thereafter, it is fed back through a predetermined amount. In this embodiment, the spur 6 contactable to the record side of the sheet S determines the position of the sheet S. Therefore, even if a lever sensor is abutted to the sheet S to the non-record side, the position of the sheet S does not change. However, if the sheet position is determined by the discharging roller, if the lever is contacted to the non-record side, the sheet S is away from the discharging roller by the force of the lever. In addition, in an ink jet recording apparatus, if a member is abutted to the record surface immediately after the recording operation, the undried ink may be smeared, and therefore, non-contact type sensor such as reflection type photosensor is preferable.

Figures 17A, 17B, 17C, 17D:
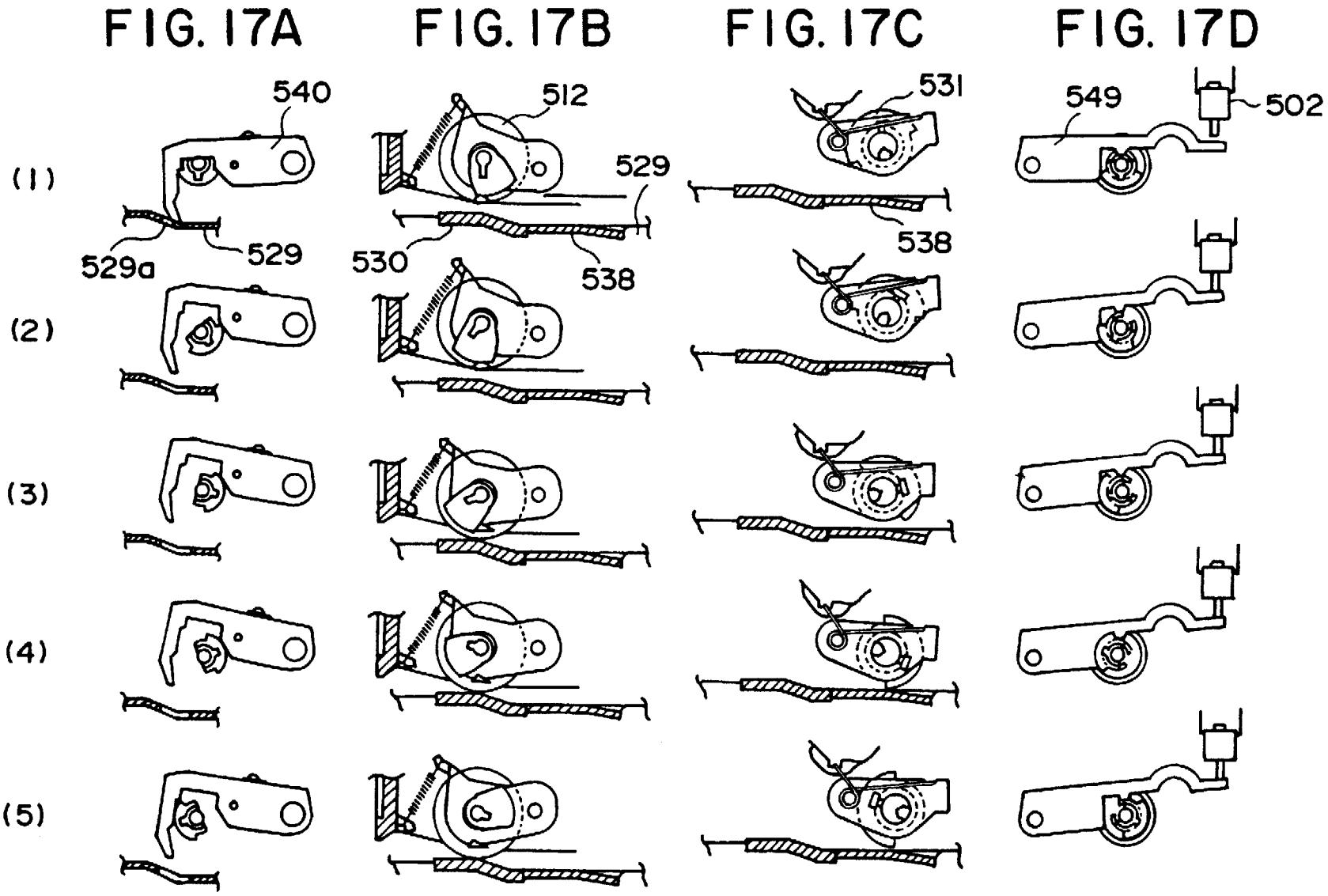
FIG. 17 illustrates operations of various parts of the automatic sheet feeder of FIG. 1.
Figure 18:
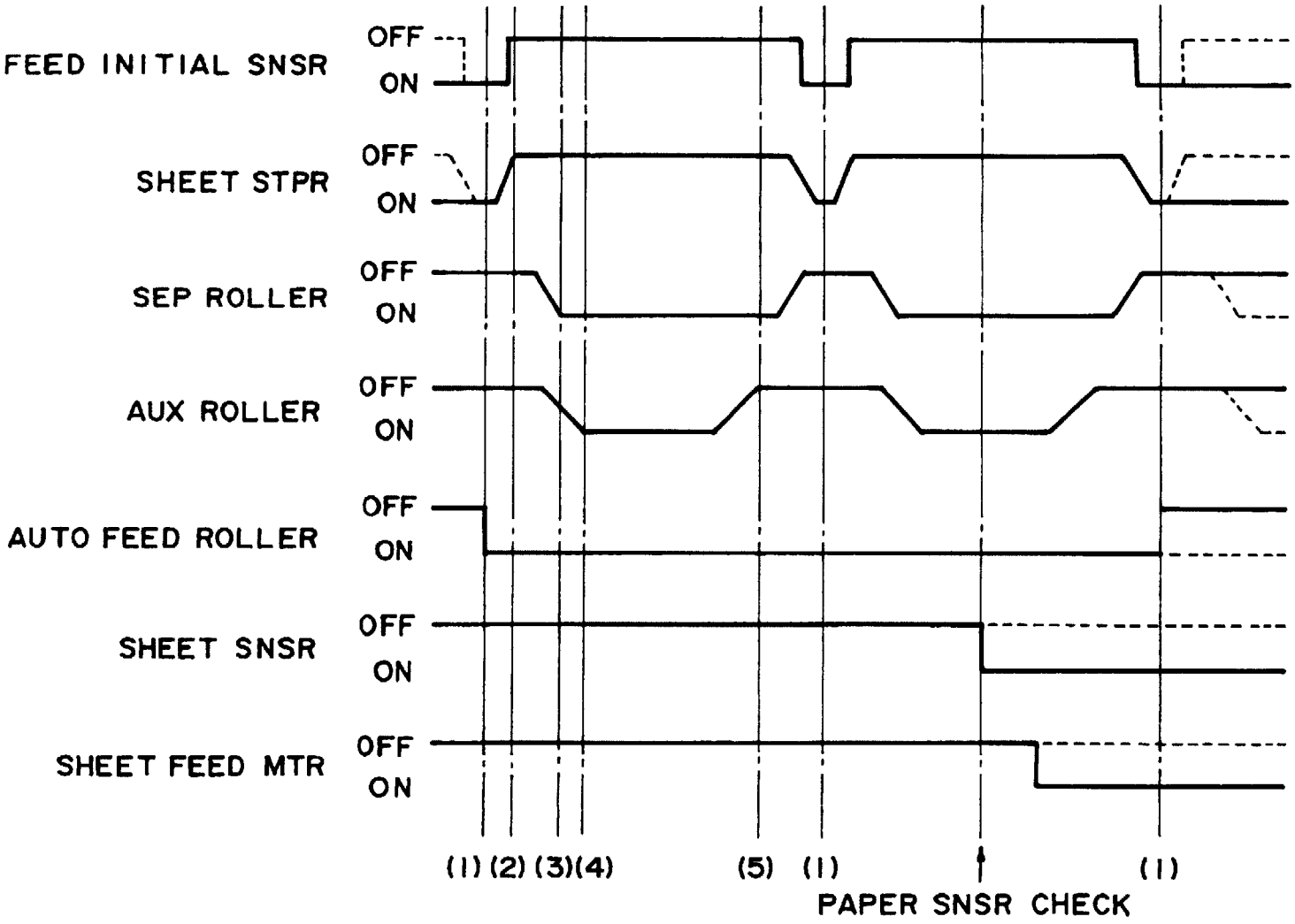
FIG. 18 is a timing chart of operations of various parts of the automatic sheet feeder of FIG. 1.

The description will be made as to the operation of the automatic sheet feeder F and related operations. FIGS. 17 and 18 show the operation of the automatic sheet feeder F according to an embodiment of the present invention. FIG. 17 illustrates the operation, and FIG. 18 is a timing chart of various elements.

First, the description will be made with respect to FIG. 17.

(1) Shows the state before the recording sheet is loaded.

(A) The sheet stopper 540 is received by a receptor hole 529*a* of the sheet feed guide 529. Therefore, the sheet S is positioned at its leading edge by the sheet stopper 540.

(B) The separation roller 512 is in its inoperative position wherein the maximum radius portion 527*b* of a separation roller cam 527 is in contact with the cam follower 511*d* of the main holder 51.

(C) The auxiliary roller 531 is in its inoperative position where a maximum radius portion S1 of the cam 533*e* of the auxiliary roller shaft 533 is at the bottom edge 511*f* of the deformed hole 511*e* of the main holder 511, and the small radius portion 531*c* of the auxiliary roller 531 faces toward the sheet feeding guide 529.

The follower 549*c* of the initial lever 549 is in the cam slot 519*e* of the clutch gear 517, and therefore, the sensor switch 502 produces on-signal.

(2) The motor 501 has started rotation, and the clutch gear 517 is approx. 30 degrees rotation position, and it is manual feed position, too.

(A) The sheet stopper 540 is out of the receptor hole 529*a* of the sheet guide 529, and as shown in FIG. 12, a sheet path is provided by a clearance S5 from a sheet feed guide 529, and it is in its inoperative position.

(B) The separation roller 512 is still in its inoperative position.

(C) The auxiliary roller 531 is still in the inoperative position.

Since the two rollers 512 and 531 and the sheet stopper 540, are all in their inoperative positions, the sheet can enter beyond the sheet stopper 540 as far as the sheet inlet (not shown) of the recording apparatus.

(D) The follower 549*c* of the initial lever 549 rides on the outer periphery of the cam 517*f* of the clutch gear 517, and therefore, the sensor switch produces the off-signal.

(3) The motor 501 as further rotated, and the clutch gear 517 is at approx. 80 degrees rotation position.

(A) The sheet stopper 540 is still in its inoperative position.

(B) The separation roller 512 is brought to its operative position prior to the auxiliary roller 531, by contacting to the friction plate A-530 of the sheet feed guide 529.

(C) The auxiliary roller 531 is still in its inoperative position. The sheet S is not yet fed and is at the initial position. Of the two rollers 512 and 531, the separation roller 512 is first placed to its operative position because the separation mechanism is first operated such that the double feed is prevented, before the start of the sheet feed by the auxiliary roller 531.

(D) The initial lever 541 still pushes the sensor switch 502, and its produces the off-signal.

(4) The motor 501 has further rotated, and the clutch gear 517 is at approx. 105 degree position.

(A) The sheet stopper 540 is still in its inoperative position.

(B) The separation roller 512 is still in the operative position.

(C) The auxiliary roller 531 is in the operative position, and the sheet feed starts.

When there is a plurality of sheets below the auxiliary roller 531, the friction coefficient between the auxiliary roller 531 and the sheet is larger than the friction coefficient between the sheets, and therefore, only the topmost sheet is fed out. In addition, the friction coefficient between the sheet and the friction plate B space 538 is also larger than the friction coefficient between the sheets, and therefore, the double feed can be prevented. Here, $$\mu y > \mu k > \mu mb$$

where μy is a friction coefficient between the auxiliary roller 531 and the sheet, μk is the friction coefficient between sheets, and μmb is a friction coefficient between the sheet and the friction plate B.

(D) The initial lever 549 still pushes the sensor switch 502, and still produces the off-signal.

(5) The motor 501 has further rotated, and the clutch gear 517 is at approx. 290 degrees rotation position.

(A) The sheet stopper 540 is still in its inoperative position.

(B) The separation roller 512 is still in the operative position, and therefore, the sheet S is fed beyond the separating portion to the sheet inlet (not shown) of the recording apparatus or portion by the separation roller 512.

(C) The auxiliary roller 531 starts to move to the inoperative position. For the same reason as stated in the above paragraph (3), the auxiliary roller 531 is first placed in the inoperative position, so that prior to the release from the separation mechanism, the sheet feeding operation of the auxiliary roller 531 is stopped, thus preventing the double feed of the sheets.

(D) The initial lever 549 still pushes the sensor switch 502, and produces the off-signal.

Thereafter, the state described in paragraph (1) is established, thus completing one cycle of the operation.

In this embodiment, the apparatus is very small, and the roller diameter as of the rollers are so small the sheet S does not reach the sheet inlet of the recording apparatus through one cycle operation, and the sheet is fed through two cycles, normally. At the unshown sheet inlet of the recording apparatus, there is a paper sensor 14, which detects the arrival of the sheet S. If the paper sensor 14 detects the presence of the sheet when the clutch gear 517 rotates through approx. 170 degrees from the initial position between (4)–(5) in the second cycle, the sheet feeding operation is carried out further to the position of 230 degrees. Thereafter, the sheet feed of the recording apparatus is started in cooperation with the automatic sheet feeder.

This is for the purpose of aligning the leading edge of the sheet (registration). The sheet is fed while pushing the sheet by the automatic sheet feeder, and therefore, the sheet is assured to be caught by the recording apparatus or station. At this time, in order to improve the sheet feeding accuracy, the sheet feeding speed is a little slower in the recording apparatus side.

Depending on the size of the sheet, the paper sensor 14 does not detect the sheet even through the two cycles, and therefore, in this embodiment the same operations are carried out until four cycles.

After the sheet is supplied to the recording apparatus, the automatic sheet feeder returns to the initial state (above paragraph (1)). At this time, the leading edge 540*b* of the sheet stopper remains on the sheet, but the stopper spring 541 applies such a small force as is not influential to the sheet feeding accuracy of the recording apparatus.

Until the position of (2) paragraph, the motor 501 is rotated at a speed smaller than in the automatic sheet feeding mode (approx. 500 pps in this embodiment), and the motor 501 is stopped. At this time, as described hereinbefore, the operator is permitted to directly insert the desired sheet to the sheet inlet of the recording apparatus or station. This mode is used when the recording sheet is so thick that the automatic sheet feeder F is not usable.

The description will be made as an information processing apparatus and the electric circuit therefor in which the recording apparatus of this embodiment is built in.

Figure 31:
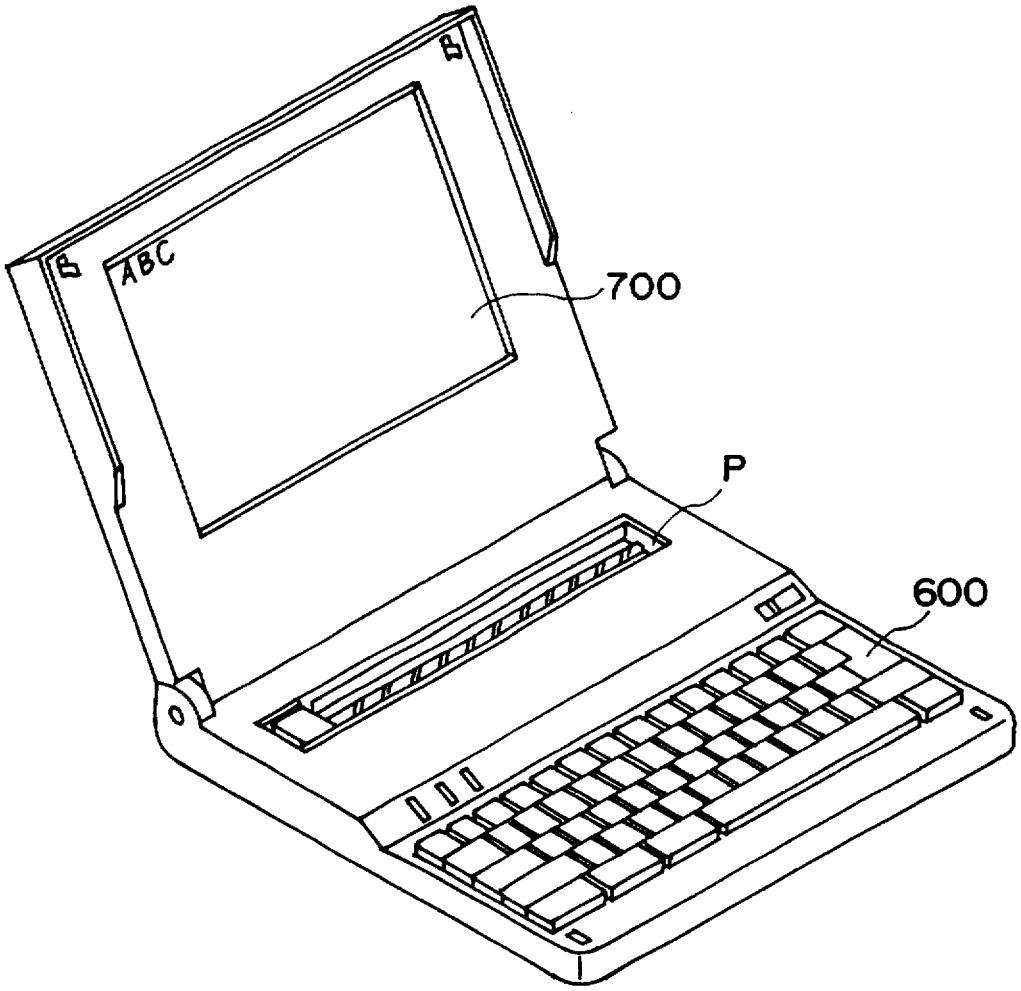
FIG. 31 is a perspective view of an example of a personal computer provided with the sheet feeding apparatus according to an embodiment of the present invention.

FIG. 31 is a perspective view of an outer appearance of an information processing apparatus 400 having a built in recording apparatus according to an embodiment of the present invention.

In this embodiment, reference P designates the printer described in the foregoing; 600 is a keyboard provided with letter keys, numerical keys, other character keys, and various command keys; and 700 is a display.

Figure 19:
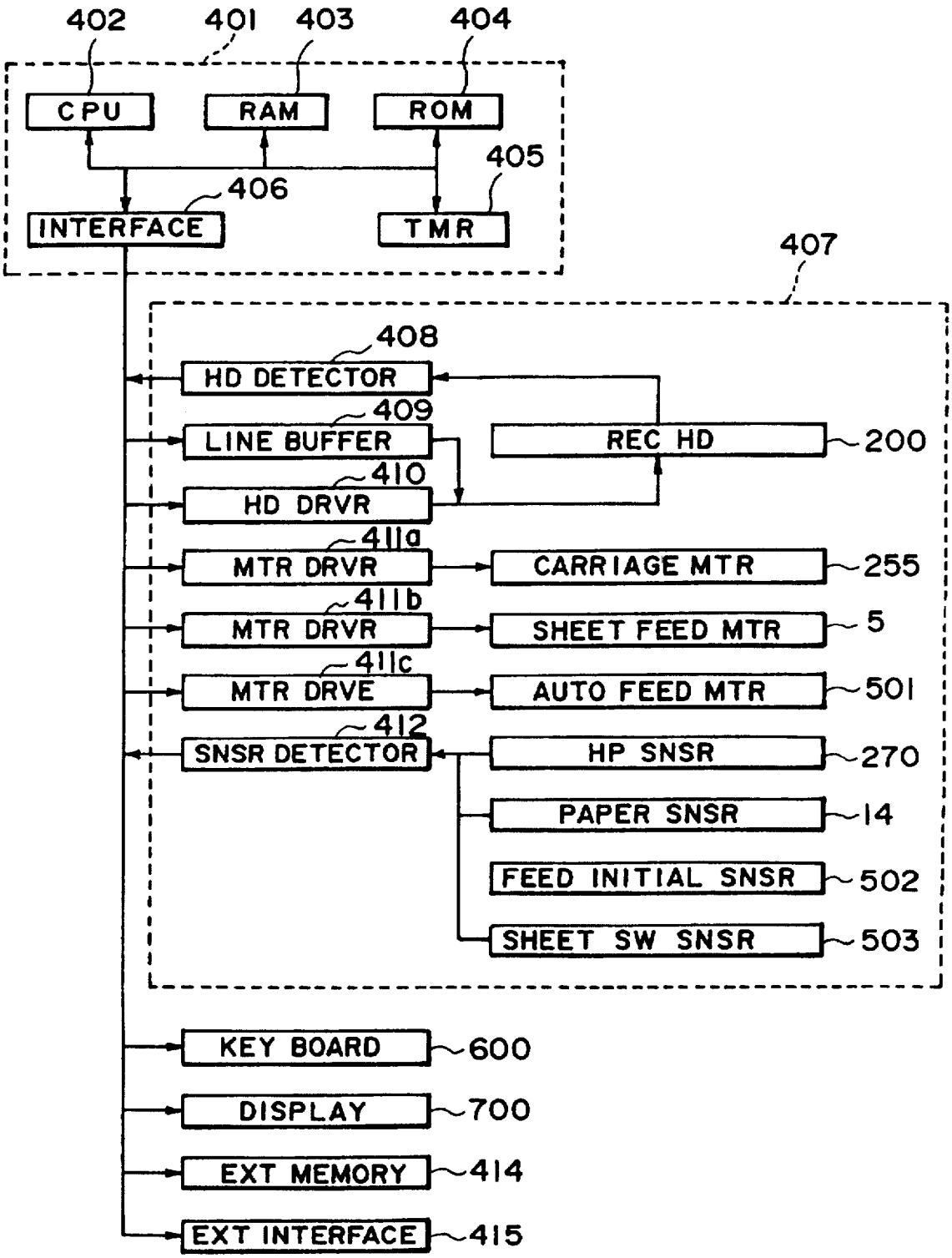
FIG. 19 is a block diagram of a control circuit for the automatic sheet feeder of FIG. 1.

Referring to FIG. 19, there is shown a block diagram of an electric circuit of the information processing apparatus according to an embodiment of the present invention. It comprises a controller 401 for a main control operation, a CPU 402 in the form of a microcomputer for executing programmed steps, a RAM 403 having a working area and a area for converting a text data or image data into dot data, a ROM 404 storing fixed data such as font data or program corresponding to the operational step, a timer for producing necessary timing for the cyclic operation of the CPU 402 and the recording operation of the printer P, and an interface for connecting the peripheral device with the signals from the CPU 402.

Designated by a reference numeral 407 is a controller for a printer P. A head detector 408 detects absence, presence, type of the recording head 200, an output of a sensor for detecting the temperature of the recording head, an output of a sensor for detecting presence or absence of the ink in the ink container 201 or other recording head information. Designated by a reference numeral 409 is a line buffer for storing record data for the recording head 200; 410 a head driver for supplying recording signal or electric power; 411*a*, 411*b* and 411*c* are motor drivers for supplying signal or electric power for driving the carriage motor 255, the sheet feeding motor 5 and automatic sheet feeding motor 501; and 412 is a sensor detector for detecting output of the home position sensor, the paper sensor 14, the sheet feed initial sensor 502, sheet feed switching sensor 503 or another sensor. Reference numeral 414 designates external memory such as FDD, HDD, RAM card or the like; and 415 is an external interface for communication with other information processing apparatus and for control of peripheral devices by direct connection to internal bus. Although not included in the block diagram of FIG. 19, there is a voltage source for providing electric power to the electric circuit. It includes a chargeable type battery, a disposable dry battery or AC voltage source converter usable when the information processing apparatus main assembly is fixedly installed.

With the electric circuit structure, the recording operation is carried out onto the sheet S. Referring to FIGS. 20–23, the sequential operations of the automatic sheet feeder F will be described.

Figure 20:
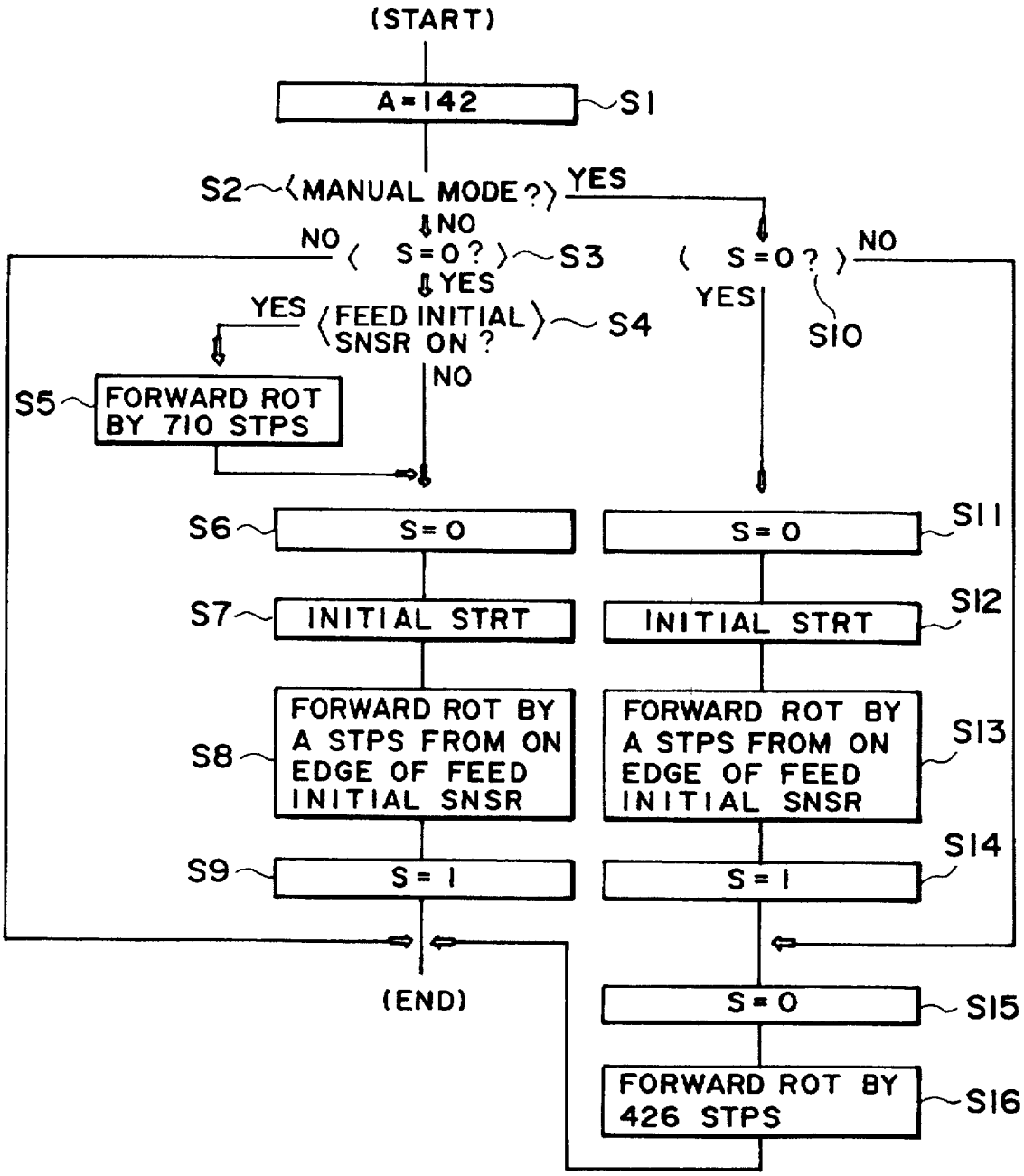
FIG. 20 is a flow chart of initial operations of the automatic sheet feeder of FIG. 1.

FIG. 20 is a flow chart of initial operations of the automatic sheet feeder F when the main switch of the recording apparatus or information processing apparatus is actuated. When the main switch is actuated, and the initializing operations of the automatic sheet feeder F are started, a value corresponding to 142 steps is stored as a initial value in an initial step storing region in the RAM at step S1. This value represents how much steps the automatic sheet feeder motor 501 to operate from the on-edge of the sheet feed initial sensor 502.

At the next step, S2, the discrimination is made as to whether the automatic sheet feed mode or manual sheet feed mode is selected. When the sheet feed switching sensor 503 is in off-state, and therefore, automatic sheet feed mode is discriminated, the content in the initial absence or presence storing region in the RAM is checked. If it is 0, the initializing operation is not completed. If it is 1, the initializing operation has been completed. As the initial value it is 0.

If it is discriminated at step S3, it means that the automatic sheet feeder F has completed the initializing operation and stop in that state at the time of the previous main switch deactuation, and therefore, the initializing operation of the automatic sheet feeder F is deemed as having been completed, as it is. If 0 is detected at S3, that is, the initilizing operation has not yet been completed. Then, at step S4, the discrimination is made as to whether the sheet feed initializing sensor 502 is in on-state or not. If so, the automatic sheet feed motor 501 is driven by 710 steps at step S5 so as to deactuate the sheet feed initial sensor 502. Thereafter, the step S6 is executed. If the sheet feed initialization sensor 502 is in the off-state, the operation proceeds to S6 directly.

At step S6, the initializing operation is started, and the automatic sheet feed motor 501 is driven, and therefore, the separation roller 512 in the automatic sheet feeder F, the auxiliary roller 531 and sheet stopper 540, is indicated as being out of the initial completion position, that is, the home position, the setting 0 in the initial presence or absence memory region.

At step S7, the drive of the automatic sheet feed motor 501 is started. At step S8, the on-edge of the sheet feed initial sensor 502 is detected, and thereafter, the automatic sheet feed motor 501 is driven by the number of steps corresponding to the value stored in the initial step memory region. Then, the automatic sheet feed motor 501 is stopped, and the next step, SQ is executed. At step SQ, in order to show the completion of the initializing operation, 1 is set in the initial presence or absence memory region. Thus, the initializing operation of the automatic sheet feeder F is completed.

If the result of discrimination at step S2 indicate the manual mode, the operation proceeds to step S10.

In step S10, the same discrimination as in step S3 is carried out. At step S10, if the completion of the initilizing operation is detected, the operation proceeds to S15.

At step S15, upon start of the drive of the automatic sheet feed motor 501 to control the automatic sheet feeder F to meet the manual mode operation, 0 is set in the initial presence or absence memory region in order to show that the separation roller 512, the auxiliary roller 531 and the sheet stopper 540 of the automatic sheet feeder, in the similar manner to step S6.

At step S16, the automatic sheet feed motor 501 is driven by 426 steps to place the automatic sheet feeder F at a position meeting the manual mode. Thus, the initializing operation of the automatic sheet feeder F is completed.

If the result of discrimination at step S9 indicates non-completion of the initializing operations, step S11 is carried out. The operations from step S11 to step S14, are the same as the operations from step S6 to S9. Then, the operation proceeds to step S15. Thereafter, the same controlling operations are carried out as in the step S15 and the subsequent steps.

Figure 21:
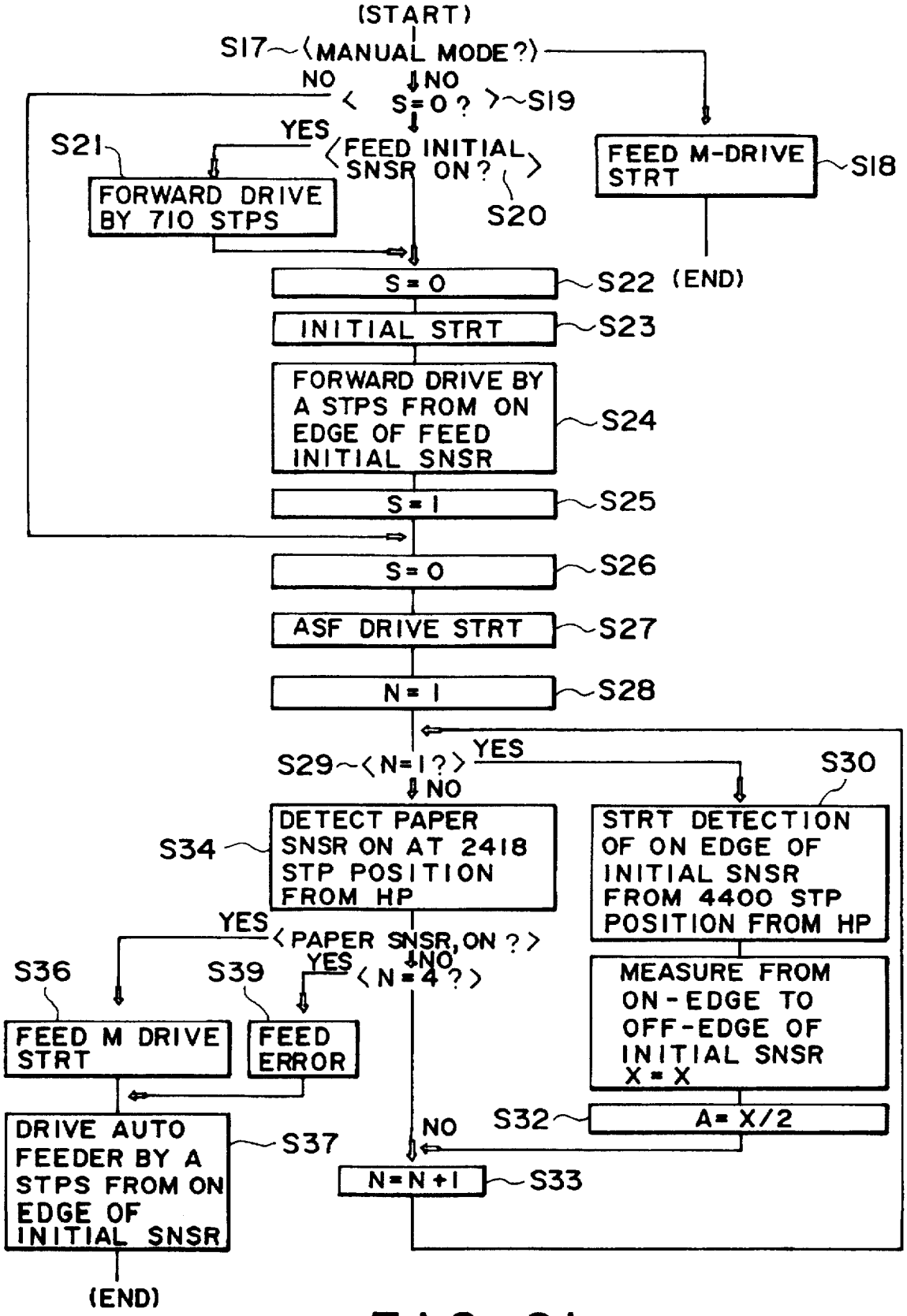
FIG. 21 is a flow chart of sheet feeding operations of the automatic sheet feeder shown in FIG. 1.

FIG. 21 is a flow chart illustrating operation of the automatic sheet feeder F until the start of the sheet feed motor drive in the sheet feeding operation.

When the sheet feed instructions are generated, the discrimination is made at step S17 as to whether or not the automatic sheet feeder F is in the automatic sheet feed mode or the manual sheet feed motor on the basis of the state of the sheet feed switching sensor 503 as in the step S2.

If the result of discrimination at step S17 indicates the manual mode, the automatic sheet feeder F is not operated, and therefore, the operation proceeds to step S18, where the sheet feed motor 5 is driven, and the operation is completed. If the result of discrimination at step S17 indicates the automatic sheet feed mode, step S19 is carried out, and the same operation is carried out from step S19 through step S25, as in the steps S3 through S9. Thereafter, the operation proceeds to S26.

At step S26, upon start of the drive of the automatic sheet feed motor 501 for effecting the automatic sheet feed, 0 is set in the initial presence or absence memory region in order to show that the separation roller 512, the auxiliary roller 531 and the sheet stopper 540 of the automatic sheet feeder F is going to be away from the home positions.

At step S27, the drive of the automatic sheet feed motor 501 is started, thus starting the automatic sheet feed.

In step S28, 1 is set in a rotation number memory region in the RAM as an initial value to permit discrimination of how many rotations are carried out by the separation roller 512 and the auxiliary roller 531 from the start of the automatic sheet feed operation. Subsequently, at step S29, the discrimination is made as to whether it is the first rotation or not from the start of the automatic sheet feed by the various rollers.

If the result of discrimination at step S29 indicates the first rotation, the operation proceeds to S30. In the first rotation drive, in order to measure the region in which the sheet feed initial sensor 502 is in the on-state, the on-edge detection of the sheet initial sensor 502 is started at step 30 from the position 4400 step (automatic sheet feed motor 501) away from the home position of the automatic sheet feeder F.

At step S31, the measurement is effected from the on-edge of the sheet feed initial sensor 502 to the off-edge. In step S32, one-half of the value from the on-edge of the sheet feeding initial sensor 502 to the off-edge is stored in the initial step memory region. Then, the operation proceeds to S33, where for the purpose of preparation for the discrimination of the start of the second rotation, 2 is set in the rotation number memory region.

In step S29, the discrimination is made again as to whether the various rollers making the first rotations. Since the first rotations have been completed, and the step S33 has been executed, the result of the discrimination is negative, and therefore, the operation proceeds to step S34, where during the second rotation, the on-state of the paper sensor 14 is detected at the position 2418 steps (automatic sheet feed motor 501) away from the home position.

If the on-state of the paper sensor 14 is discriminated at step S35, the automatic sheet feed motor 501 is driven by 853 steps. Thereafter, the operation proceeds to S36, where the drive of the sheet feed motor 5 is started. In step S37, the automatic sheet feed motor 501 drives corresponding to the value stored in the initial step memory region from the on-edge of the sheet feed initial sensor 502. Thus, the operation is completed.

If the result of discrimination at step S35 indicates the off-state of the paper sensor 14, the operation proceeds to step S38, where the discrimination is made as to whether or not the various rollers have made four rotations. At the point of time, the various rollers are in the second rotations, and therefore, the operation proceeds to S33, where the preparation is made for the third rotation, and the rotation continues to the third.

At step S29, the discrimination is made again as to whether or not it is in the first rotation. Since it is in the third rotation, the operation proceeds to step S34. During the third rotation, the on-state is detected from the paper sensor at a position 2418 steps (automatic sheet feed motor 501) away from the home position. The result of discrimination at step S35 indicates the on-state of the paper sensor 14, the operation proceeds to S36 and to step S37, in the similar manner as described above. If the result of discrimination at step S35 indicates that the paper sensor 14 is in the off-state, the same operations as in the step S38 are carried out. Since at that time, the rollers are in the third rotations, the operation proceeds to step S33, where the preparation is made for the discrimination of the fourth rotation, and continues to fourth rotation. At step S29, the discrimination is made again as to whether it is in the first rotation or not. Since it is in the fourth rotation, the operation proceeds to step S34, where the on-state of the paper sensor 14 is detected at a position 2418 steps (automatic sheet feed motor 501) away from the home position during the fourth rotation.

At step S14, if the on-state of the paper sensor 14 is discriminated, the operation proceeds to step S36 and to step S37 to effect the similar control operations. If the discrimination in the step S35 indicates the off-state of the paper sensor 14, the same operations as in step S38 is carried out. In this case, it has turned out that the paper sensor 14 is not actuated even during the fourth rotation, and therefore, the operation proceeds to step S39, where the abnormal state is informed to the operator by error message display or buzzer. Thereafter, the operation proceeds to step S37 to effect the same operation as descried above.

Figure 22:
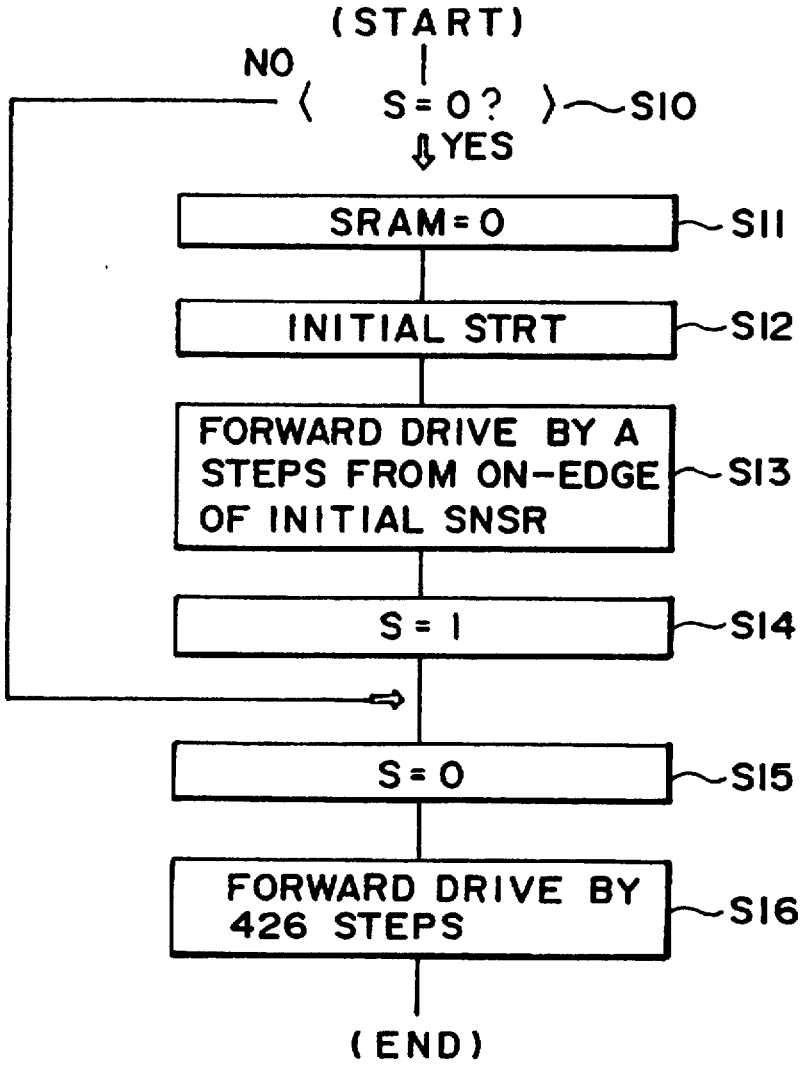
FIG. 22 is a flow chart of operations for switching from an automatic sheet feeding mode to a manual sheet feeding mode in the automatic sheet feeder of FIG. 1.

FIG. 22 is a flow chart of the operation of the automatic sheet feeder F when the operational mode is switched from the automatic sheet feed mode to the manual sheet feed mode.

When the sheet feed switching sensor 503 is switched from the automatic sheet feed mode to the manual mode, the operations of steps S10 through steps S16 having been described in the initial operation process of the automatic sheet feeder F, are carried out, and this process is completed.

Figure 23:
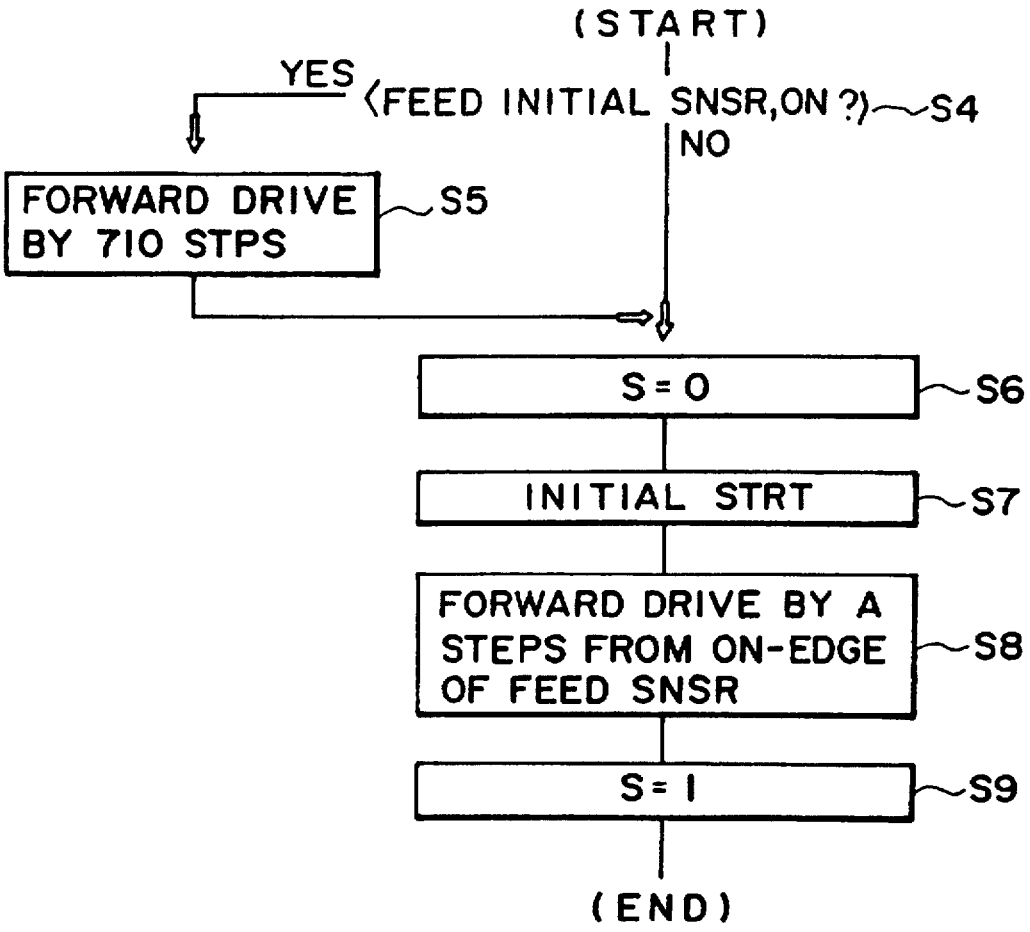
FIG. 23 is a flow chart of operations for switching from the manual mode to the automatic sheet feeding mode in the automatic sheet feeder of FIG. 1.

FIG. 23 is a flow chart of operations of the automatic sheet feeder F when the mode is switched from the manual mode to the automatic mode. When the mode is changed from the manual mode to the automatic mode, the sheet feed switching sensor 503 detects the event, and the operations from steps S4 through S7 having been described in the initializing operations of the automatic sheet feeder F, are carried out, and this process is completed.

Even if the measurement up to the actuation of the sheet feed initial sensor 502 (steps S30–S32) involves variations, it is possible to stop the automatic sheet feed motor 501 substantially at the center of the own-region of the sheet feed initial sensor 502, and therefore, the variations of the home position of the automatic sheet feeder F can be suppressed.

The description will be made as to a recording apparatus which is suitable to use the automatic sheet feeder of this invention.

Figure 32:
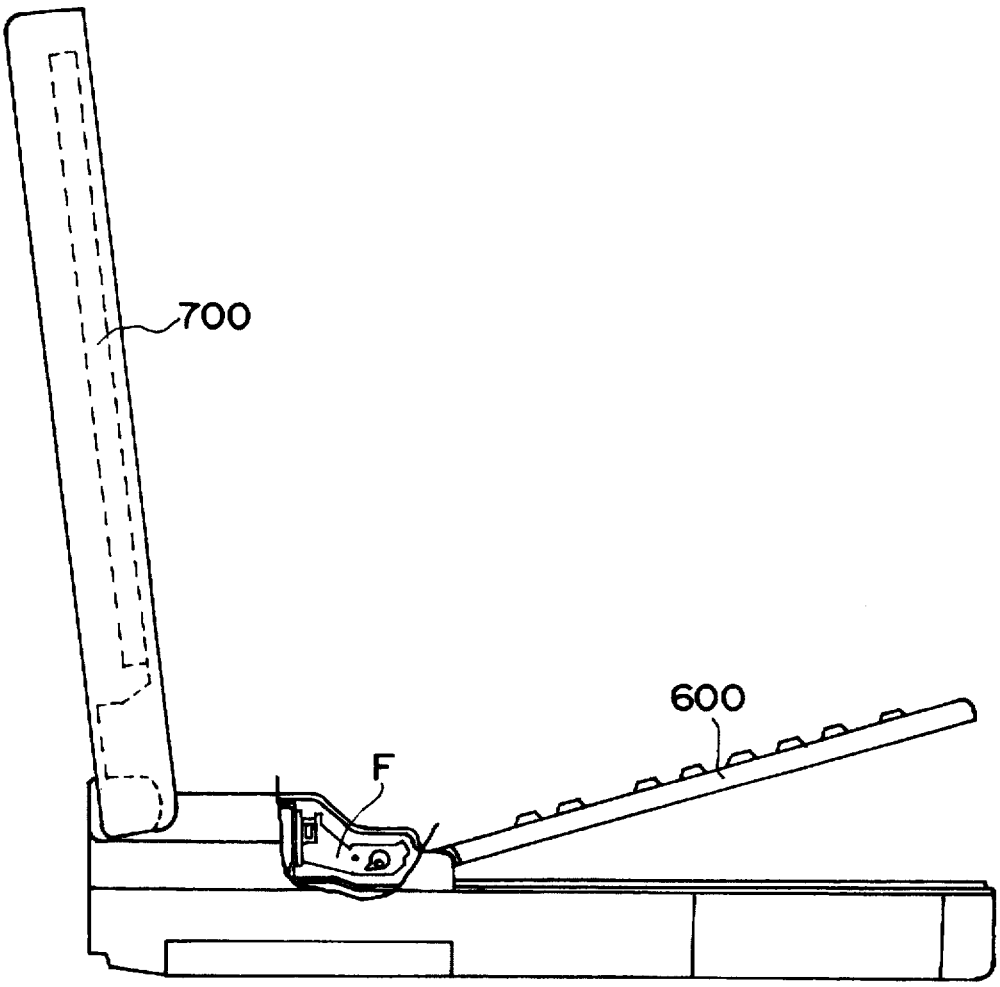
FIG. 32 is a longitudinal sectional view of a personal computer of FIG. 31.

Referring to FIGS. 31 and 32, there is shown a lap-top personal computer including a key board 600, a display 700, and the built-in printer P and automatic sheet feeder F which have been described hereinbefore. A sheet feed guide 529 of the automatic sheet feeder F is disposed below the keyboard 600, and the sheet (of paper) can be set in the automatic sheet feeder F, if the keyboard 600 is raised. The sheet having been subjected to the printing operation of the printer P is discharged through the discharge outlet. The small size is one of the advantages of such a personal computer, and therefore, it is preferable that the thickness thereof is as small as possible. The automatic sheet feeder of this invention is particularly suitable to reduce the size. As described hereinbefore, according to the embodiments of the present invention, the separation roller is displaced from its operative position to its inoperative position in the sheet feeding so as to avoid the backward tension applied to the sheet, and therefore, the inclined sheet feeding or jam of the sheet attributable to the backward tension, can be avoided.

In addition, because of this feature, the sheet feeding force can be minimized, thus further reducing the size of the apparatus.

Figure 33:
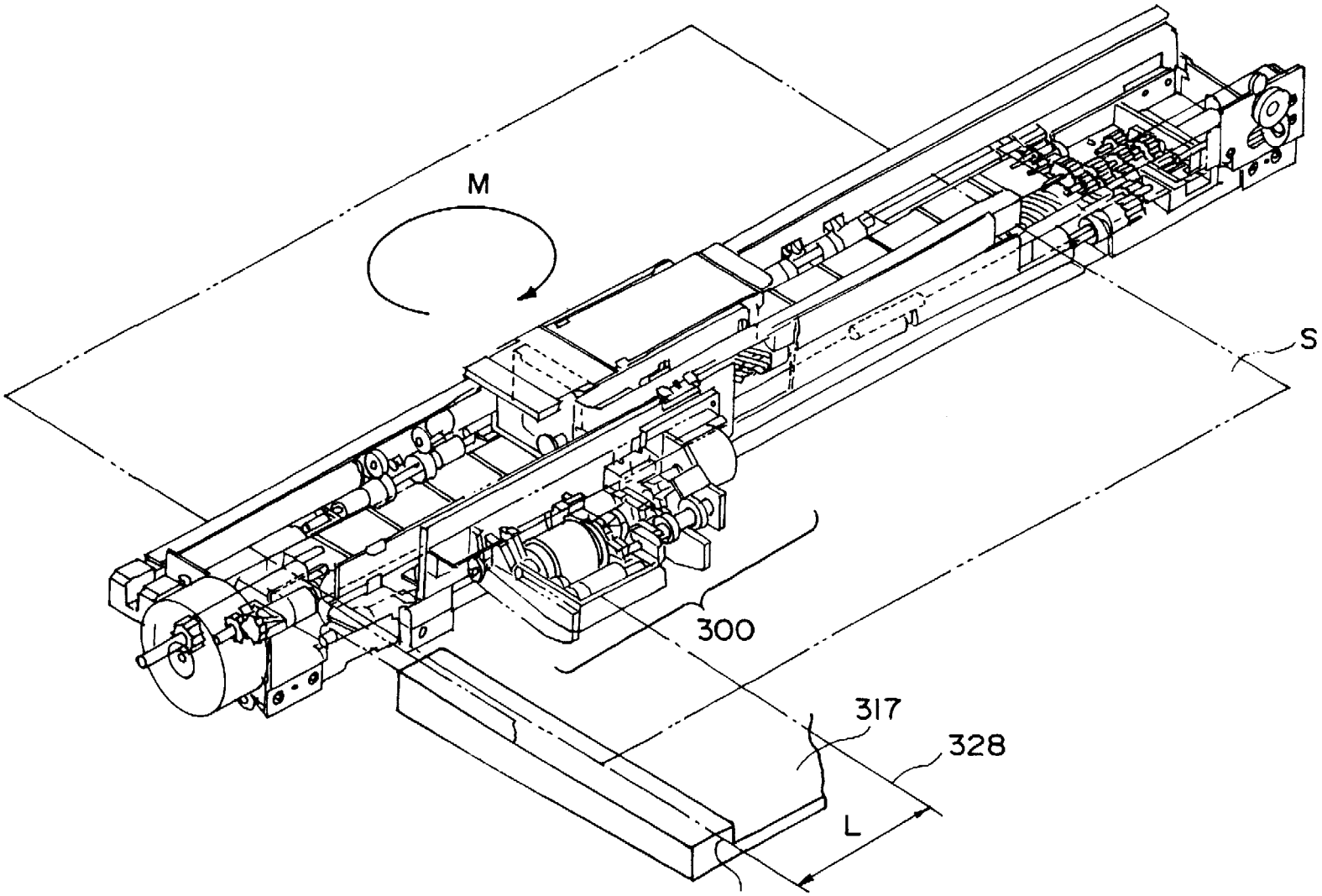
FIG. 33 is a perspective view of the automatic sheet feeder according to a second embodiment of the present invention, when it is mounted in the recorder.
Figure 34:
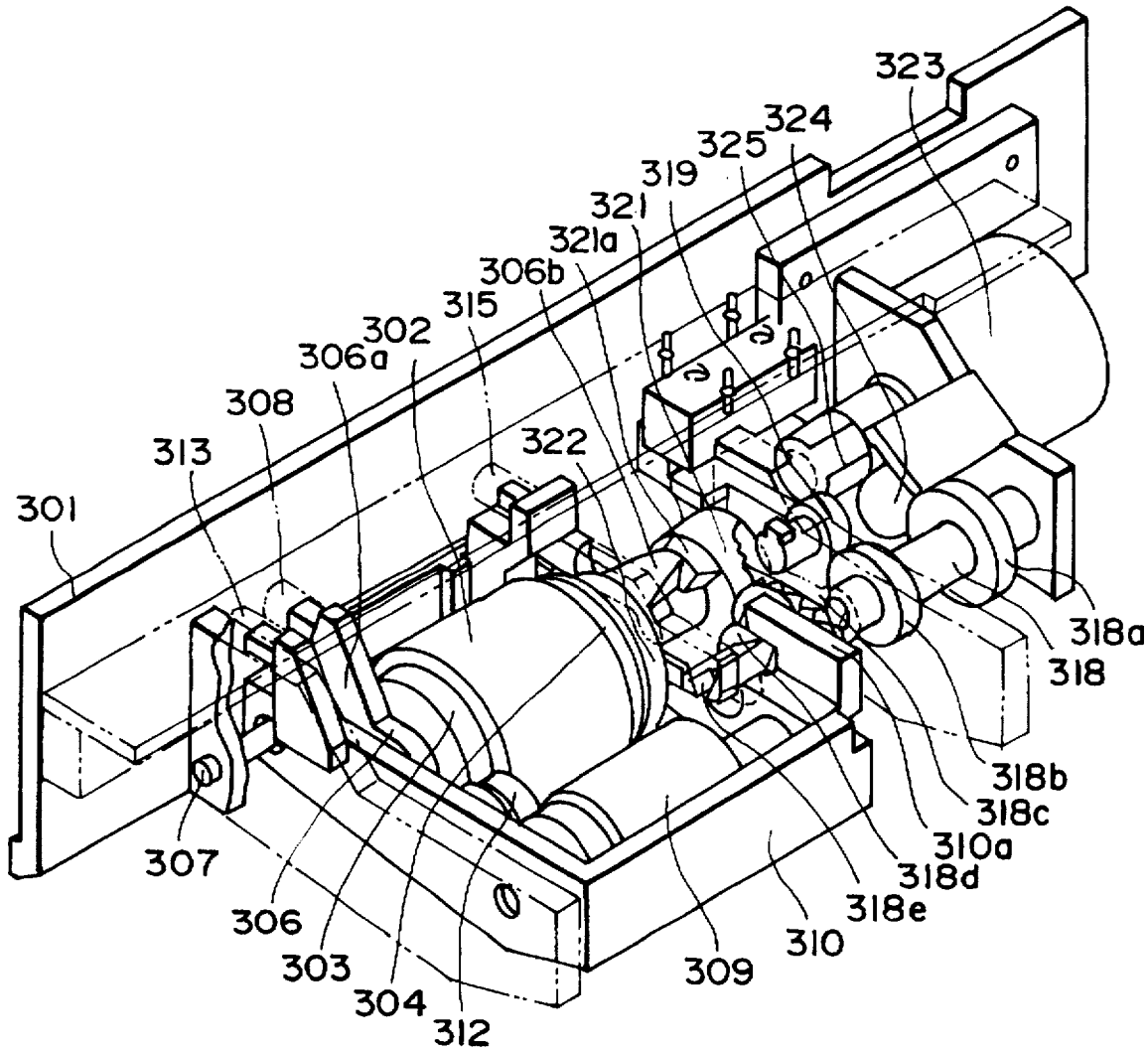
FIG. 34 is a perspective view of an automatic sheet feeder shown in FIG. 33.
Figure 35:
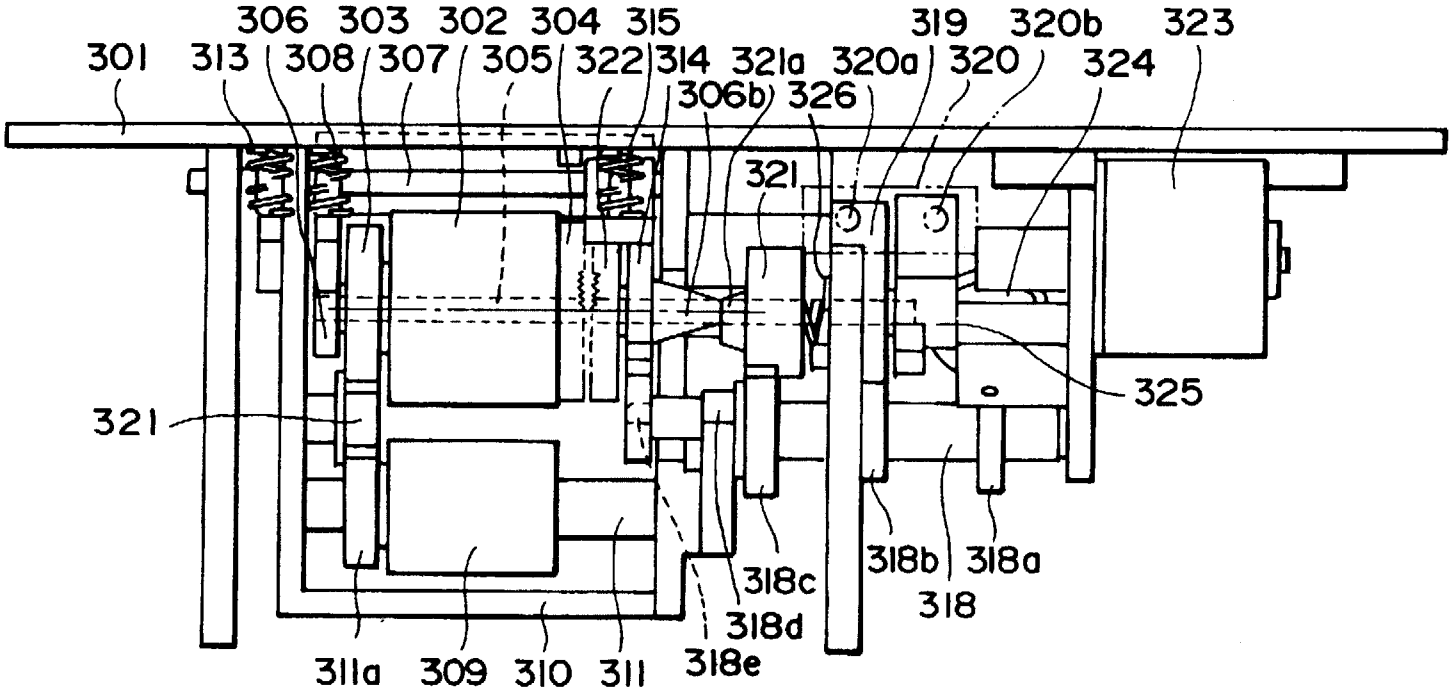
FIG. 35 is a top plan view of the automatic sheet feeder of FIG. 34.
Figure 36:
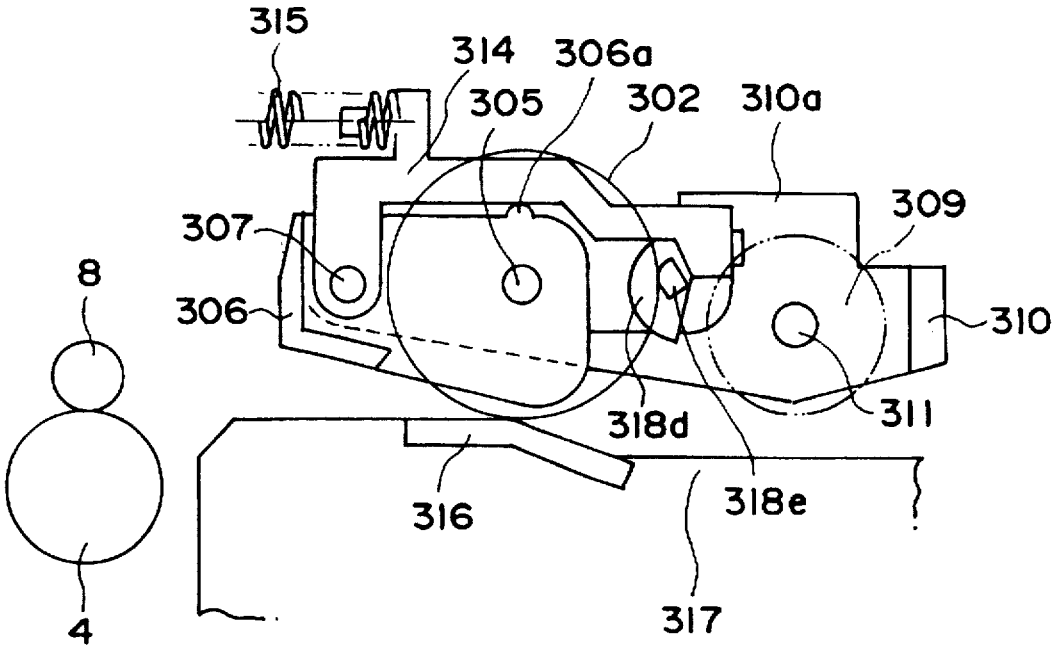
FIG. 36 is a longitudinal sectional view of the automatic sheet feeder shown in FIG. 34.

Referring to FIG. 33–40, there is shown another example of the automatic sheet feeder. FIG. 34 is an outer perspective view; FIG. 35 is a top plan view; FIG. 36 is a sectional view. A main holder 301 ultimately supports all of the parts of the automatic sheet feeder, and in addition, it supports the automatic sheet feeder on the ink jet recording apparatus.

A separation roller 302 separates the sheet one-by-one by its rotation and feeds it into the sheet feeding station of the ink jet recording apparatus. To the roller, a separation gear 303 and a separation ratchet 304 are fixed. It is rotatable about a separation shaft 305. The separation shaft 305 is fixed to a separation holder 306, which in turn is rotatably supported on the main holder 301 by a main holder shaft 307. A separation spring 308 is disposed between a projection 306*a* of the separation holder 306 and the main holder 301. In FIG. 36, the separation holder 306 is rotated in the clockwise direction to urge the separation roller 302 to a separation pad 316. The urging force of the separation spring 308 is 10–50 gf in this embodiment. For the purpose of simplification of the explanation, it is assumed that the spring force is 10 gf.

Designated by a reference numeral 309 is an auxiliary roller for feeding the sheet to the separation roller 302, and is fixed on the auxiliary roller shaft 311. It is rotatably supported on the auxiliary roller holder 310 together with the auxiliary roller gear 311*a* fixed to the auxiliary roller shaft 311. The auxiliary roller holder 310 is rotatably supported relative to the main holder 310 by a main holder shaft 307. The auxiliary roller 309 is rotated at the same peripheral speed as the separation roller 302, by an idler gear 312.

An auxiliary roller spring 313, similarly to the separation holder 306 described above, urges the auxiliary roller holder 310 in the clockwise direction in FIG. 36 so as to urge the auxiliary roller 309 toward the sheet holder 317. The urging force of the auxiliary roller spring 313 is not limited in its upper level since what is required is to assuredly feed the sheet S by the auxiliary roller 309. However, in this case, the good results have been obtained if it is no less than 20 gf. In the following explanation, it is assumed as being 50 gf.

A separation pressure arm 314 rotates the separation holder 316 in the clockwise direction in FIG. 33 through a projection 306*a* of the separation holder 306 by a separation pressure arm spring 315 about a main holder shaft 307. By doing so, the separation roller 302 is urged to the separation pad 316. The urging force of the separation roller 302 by the separation pressure arm spring 315 is determined with a tension, since it is influential to the separation performance. In this example, the good results have been provided if it is no less than 20 gf. In the following explanation, it is assumed to be 100 gf.

In FIG. 36, designated by reference numeral 316 is a separation pad for separation and supporting the sheet stacked; and 317 is a sheet holder for holding the sheet. A reference numeral 318 is a cam shaft and is rotationally driven through a gear 318*a* and a reduction mechanism 324 from an automatic sheet feed motor 323. To the cam shaft 318, there are fixed thereto a switch cam 318*b* for actuating and deactuating the sheet feed initial sensor 320*a* through a switching arm 319 together with the gear 318*a*, a gear 318*c* for transmitting rotation of the cam shaft 318 to the separation roller 302, an auxiliary roller holder cam 318*d* for moving the auxiliary roller holder 310 up and down in relation to a pawl 310*a* on the auxiliary roller holder 310, a separation pressure cam 318*e* for moving a separation pressure arm 314 up and down.

The driving gear 321 and a clutch disk 322 are integrally formed and is slidably and rotatably supported relative to the separation shaft 305, and is urged by a clutch spring 326 toward the separation ratchet 304. The driving gear 321 has an integrally formed trapezoidal cam 321*a*, and the separation holder 306 has an integrally formed trapezoidal cam 306. By rotation of the driving gear 321, the driving gear 321 and the clutch disk 322 move in the axial direction of the separation shaft 305, so that the engagement between the clutch disk 322 and the separation ratchet 304 is controlled, and in addition, the drive transmission from the automatic sheet feed motor 323 to the separation roller 302. The gear ratio of the gear 318*c* of the cam shaft 318 and the driving gear 321 is 1:1, and therefore, the rotational phases of the cam shaft 318 and the driving gear 321 are the same.

A release lever 325 is rotatably supported on the main holder 301, and an end of the release lever 325 is in the form of a cam which is engaged with an end of the separation shaft 305. By this, the separation holder 306 is movable up and down, and the sheet feed switching sensor 320*b* is actuated or deactuated.

Referring back to FIG. 33, a reference numeral 328 designates a central line perpendicular to the separation shaft 305 for the separation roller 302 and the auxiliary roller 309, and is coaxial with the direction of the sheet S advancement. A left guide 317*a* is on the sheet holder 317, and guides the left edge of the sheet S at a constant position relative to the recording position. The distance L between the center line 328 and the left guide 317*a* is fixed to not more than one-half the minimum width of the sheet used with this ink jet recording apparatus. In this embodiment, the minimum size of the sheet corresponds to the longitudinal length of a postcard, and it is set 45 mm for the postcard width of 100 mm.

Figures 37A, 37B, 37C, 37D:
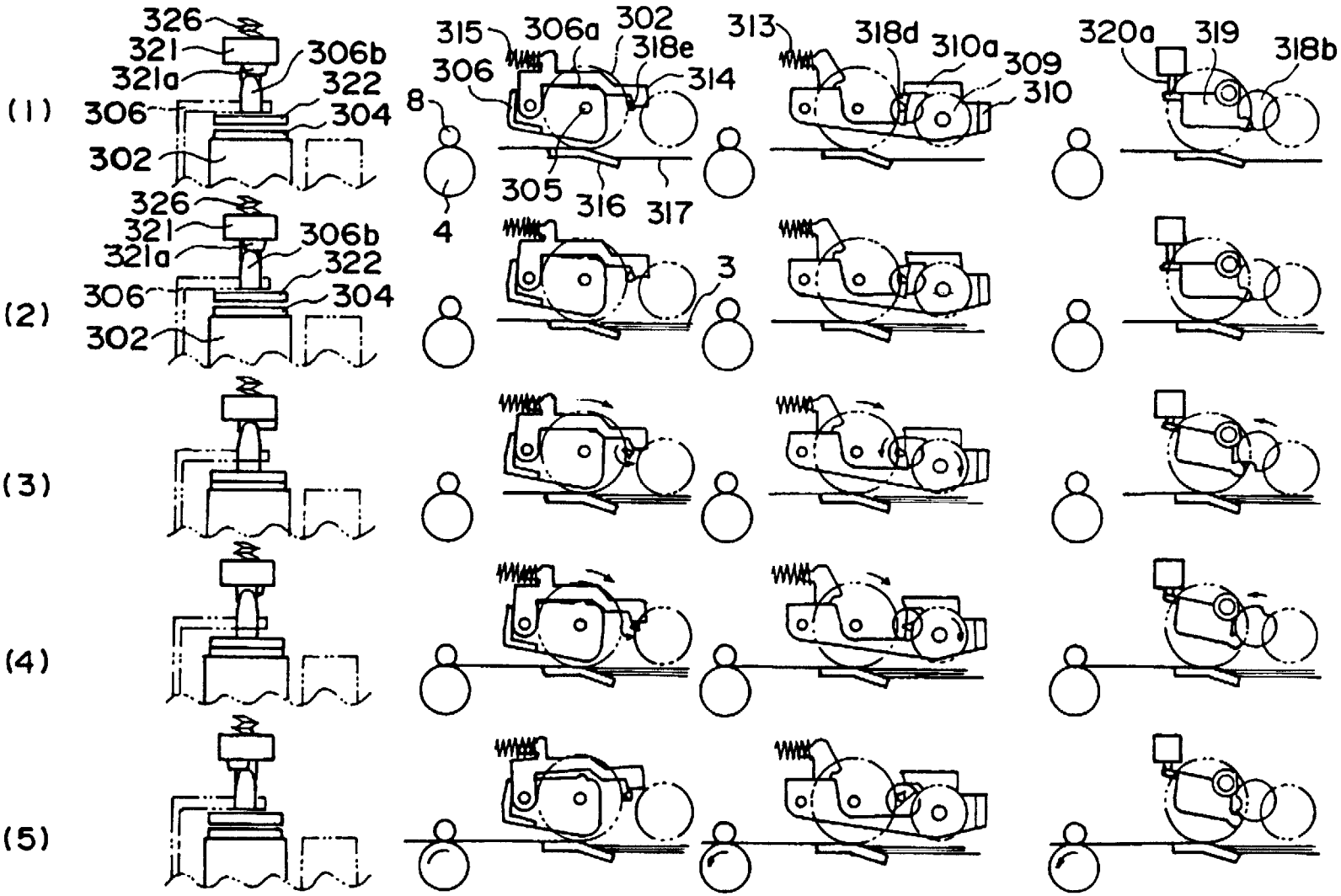
FIG. 37 illustrates operations of various parts of the automatic sheet feeder of FIG. 33.
Figure 38:
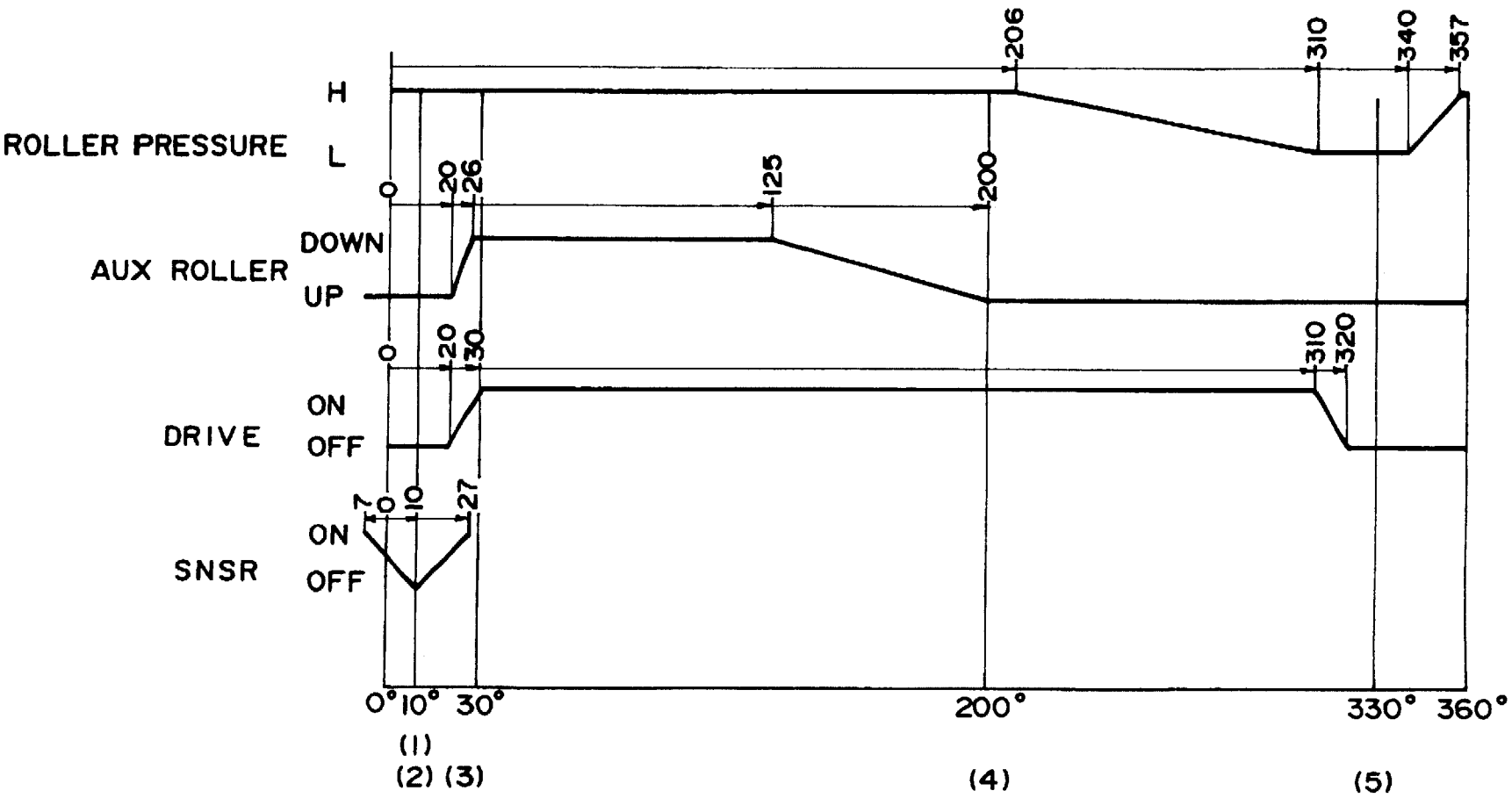
FIG. 38 is a timing chart of operations of various parts of the automatic sheet feeder of FIG. 33.
Figure 39A:
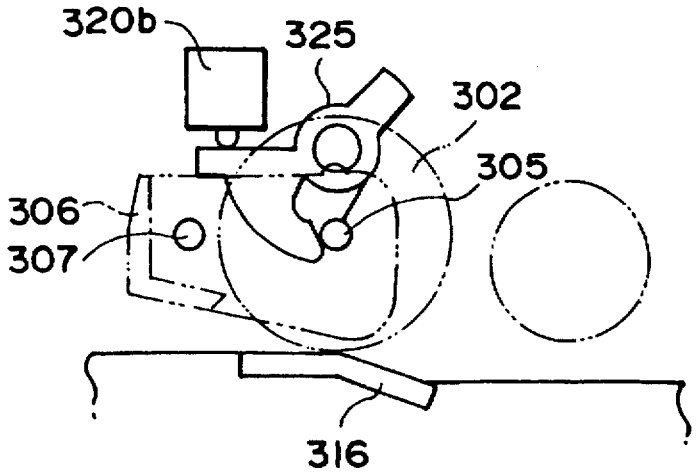
FIG. 39 is a sectional view illustrating operations of a releasing mechanism of the automatic sheet feeder of FIG. 33.
Figure 39B:
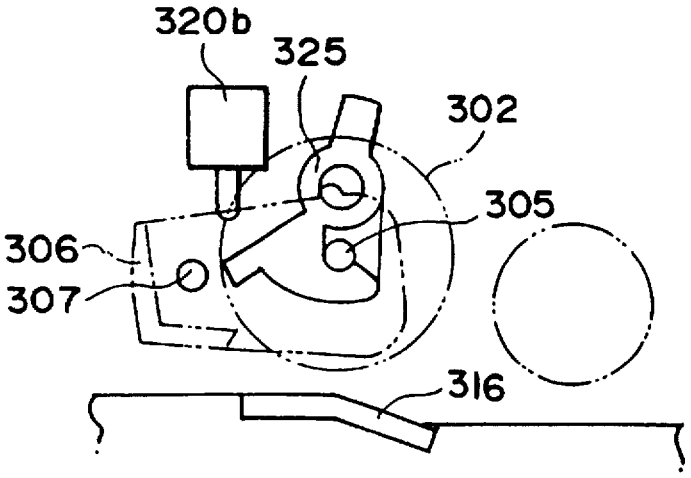

Operation of the automatic sheet feeder mechanism will be described. FIGS. 37, 38 and 39 illustrate operations of the automatic sheet feeder of this embodiment. FIGS. 37 and 38 show the change with time, and FIG. 39 illustrates operation of the releasing mechanism.

For the purpose of compact arrangement, and the minimum influence of the various rollers to the sheet S, the roller is away from the sheet S in this embodiment, as will be understood hereinafter. Therefore, there is a possibility that the sheet S can not be fed to the feeding roller 4 by one cycle of operation (one rotation of the roller) of the automatic sheet feeder. Therefore, the cycle operation is carried out twice unconditionally (FIG. 30), by which the above possibility can be avoided. During the second cycle, the sheet S has reached the nip between the feeding roller 4 and the pinch roller 8. Then, the sheet feed motor 5 is driven in synchronism with the sheet feeding operation of the auxiliary roller 309 and the separation roller 302 of the automatic sheet feeder, a predetermined period prior to the end of the second cycle operation. The feeding roller 4 is thus rotated to assuredly feed the sheet S. At this time, the amount of feed L1 of the sheet S by the automatic sheet feeder per unit time and the amount of feed L2 of the feeding roller 4 satisfy L1=L2 or L1 is slightly larger L2, preferably.

By the two cycle operations, there exists no-sheet feeding force period between the first rotation and the second rotation, which is effective to registration of the sheet S.

FIG. 37 will be explained.

(1) Shows the state before the sheet is loaded.

(A) The clutch disk 322 and the separation ratchet 304 are away from the trapezoidal cam 321*a* and the trapezoidal dam 306*b*, and therefore, the separation roller 302 is not connected with the driving source.

(B) The separation pressure arm 314 and separation pressure cam 318*e* are not contacted, and therefore, the pressure of the separation pressure arm spring 315 is effective to urge the separation roller 302 to the separation pad 316 through the separation pressure arm 314, the projection 306 and the separation holder 306. Since the separation spring 308 is in the similar situation, the separation roller 302 receives a pressure which is a sum of the pressure from the separation pressure arm spring 315 and the pressure from the separation spring 308 (10+100=110 gf).

(C) The auxiliary roller holder cam 318*d* and the pawl 310*a* of the auxiliary roller holder 310 are contacted to each other, and therefore, the auxiliary roller 309 is away from the sheet holder 317 together with the auxiliary roller holder 310 against the spring force of the auxiliary roller spring 313.

(D) The switching arm 319 is in the recess of the switch cam 318*b*, and therefore, the sheet feed initial sensor 320*a* is in the off-state.

(2) Shows the state in which the sheet S is loaded. The automatic sheet feeder does not operate between (1) and (2).

(B) The sheet S is loaded from the left side in the Figure. The separation roller 302 is urged to the separation pad 316 with the pressure (11 gf) of the separation pressure arm spring 315 and the separation spring 308, and therefore, the sheet S stops by the contact between the separation roller 302 and the separation pad 316, so that the state shown in the Figure is established.

(3) The automatic sheet feed motor 323 has started its rotation, and the cam shaft 318 is at a position of 20 degrees rotation in the counterclockwise direction.

(A) The trapezoidal cams 321*a* and 306*b* are disengaged by the rotation, and the clutch disk 322 is urged to the separation ratchet 304 by the clutch spring 326, and therefore, the separation roller 302 starts its rotation by the operation of the automatic sheet feed motor 323.

(B) Since the separation pressure cam 318*e* and the separation pressure arm 314 are not contacted, the separation roller 302 starts to the clockwise rotation while being contacted to the separation pad 316 (110 gf) by the separation pressure arm spring 316 and the separation spring 308. Therefore, only the topmost one of the sheets S is separated out and fed out by the action of the separation pad 316 and the separation roller 302.

(C) Since the auxiliary roller holder cam 318*d* and the pawl 310*a* of the auxiliary roller holder 310 are not engaged, and therefore, the auxiliary roller 309 is urged (50 gf) to the sheet S by the auxiliary roller spring 313 by way of the auxiliary roller holder 310. In addition, it is rotated in the clockwise direction by the separation gear 303, the idler gear 312 and the auxiliary roller gear 311*a*, and feed the sheet S to the left so as to assure the reaching of the sheet S to the contact point between the separation roller 302 and the separation pad 316.

(D) The sheet feed initial sensor 320 becomes in the on-state by the operations of the switch arm 319 and the switch cam 318*b*.

(4) This is the state when the cam shaft 318 has further rotated in the counterclockwise direction. What is different with respect to (C), is that the auxiliary roller holder cam 318*d* and the pawl 310*a* are contacted, and the sheet S is being fed while the auxiliary roller 309 is away from the sheet S. At this time, the sheet S has reached the nip between the feeding roller 4 and the pinch roller 8, and the further feeding is prevented. However, since the feeding force of the auxiliary roller 309 is reduced, the sheet S is not folded, and the separation roller 302 and the sheet S are in sliding relation due to the rigidity of the sheet S.

(5) Shows the state in which the cam shaft 318 has further rotated in the counterclockwise direction. At this time, the automatic sheet feed temporarily stops, and the ink jet recording operation is carried out.

(A) The clutch disk 322 and the separation ratchet 304 are separated, and therefore, the separation roller 302 is completely separated from the driving side, and is simply supported rotatable relative to the separation shaft 305.

(B) The separation pressure cam 318*e* is in contact with the separation pressure arm 314, and therefore, the separation pressure arm 314 is away from the projection 306*a*. Therefore, the pressure of the separation pressure arm spring 315 is not applied to the separation roller, and therefore, the separation roller 302 is urged to the separation pad 316 (10 gf) only by the separation spring 308.

(C) The auxiliary roller 309 is away from the sheet S.

In this state, the pressure of the separation roller 302 is small (10 gf), and the auxiliary roller 309 is away from the sheet S, and therefore, the sheet S is pulled into the ink jet recording apparatus by small force.

When the recording operation is further carried out from the state (5), and the recording is completed to such an extent that the sheet S is away from the automatic sheet feeder, the automatic sheet feeder 323 is driven up to the state (2). Thus, the first sheet operation is completed, and the mechanism is prepared for the next sheet.

FIG. 38 illustrate sequential operations, and (1)–(5) at the bottom correspond to the states (1)–(5) in FIG. 37.

Referring back to FIG. 33, the center line 328 is set to be always placed to the left of the center of the width of the sheet S, and therefore, when the sheet S is fed by the auxiliary roller 302 and the auxiliary roller 309, the sheet S always receives the clockwise moment M. Therefore, the trailing edge of the sheet S is always urged to the left guide 317*a* while being fed, and the recording sheet S is introduced into the recording station without bending along the left guide 317*a*.

FIG. 39 illustrates operations of the releasing mechanism of the automatic sheet feeder. (A) shows the using state of the automatic sheet feeder, wherein an end of the releasing lever 325 actuates the sheet feed switching sensor 320*b*, and is not contacted to the separation shaft 305. Therefore, the separation roller 302 is urged to the separation pad 316. In other words, when the sheet feed switching sensor 320*b* is in the on-state, the automatic sheet feeder is in the usable condition.

(B) shows the state in which the used sheet is not suitable for the automatic sheet feeding, as in the case of an envelope. The operator rotates the releasing lever 325 in the counterclockwise direction, by which the non-automatic feed mode is established, in which the separation shaft 305 is raised to the cam of the release lever 325, and the separation roller 302 is away from the separation pad 316. Accordingly, the sheet S supplied from the right side in FIG. 34 directly reaches to the nip between the feeding roller 4 and the pinch roller 8. At this time, the sheet switching sensor **320*b*** is in the off-state, it is possible to detect the non-usable state of the automatic sheet feeder.

The foregoing is the description of the operation of the mechanism according to this embodiment.

Figure 40:
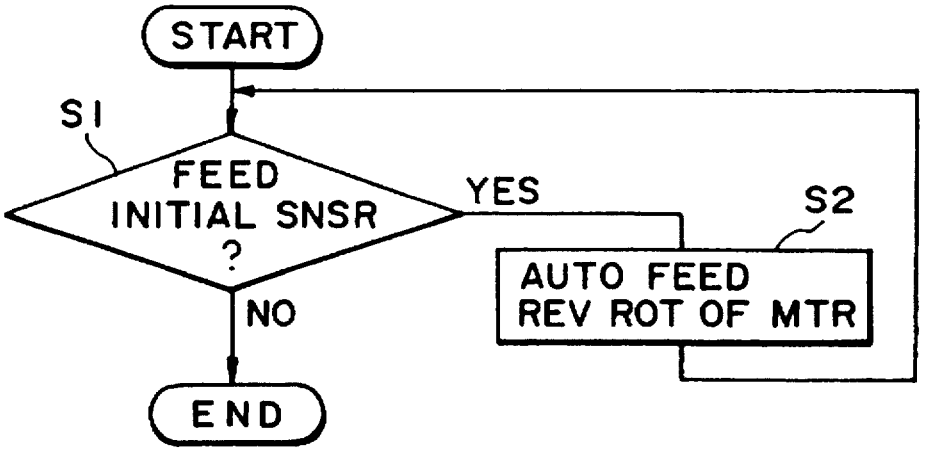
FIG. 40 is a flow chart of control operations of the automatic sheet feeder of FIG. 33.

An example of the control system will be described. FIG. 40 is a flow chart of initial sequential control operations of the automatic sheet feeder.

The actuation of the main switch is deemed as start. First, at step S1, the discrimination is made as to whether or not the sheet feed initial sensor **320*a* is on-state or not. If not, the initial state exists ((1) in FIG. 29), and therefore, the sequential operation is stopped to be prepared for the next sheet feeding instructions. At step S1, if the sheet feed initial sensor 320*a* is in the on-state, the operation proceeds to step S2, where the automatic sheet feed motor 323 is rotated in the opposite direction. At step S1, when the sheet feed initial sensor 320*a*** becomes in the off-state, the initial condition is established, and therefore, the sequential operation is stopped.

Figure 41:
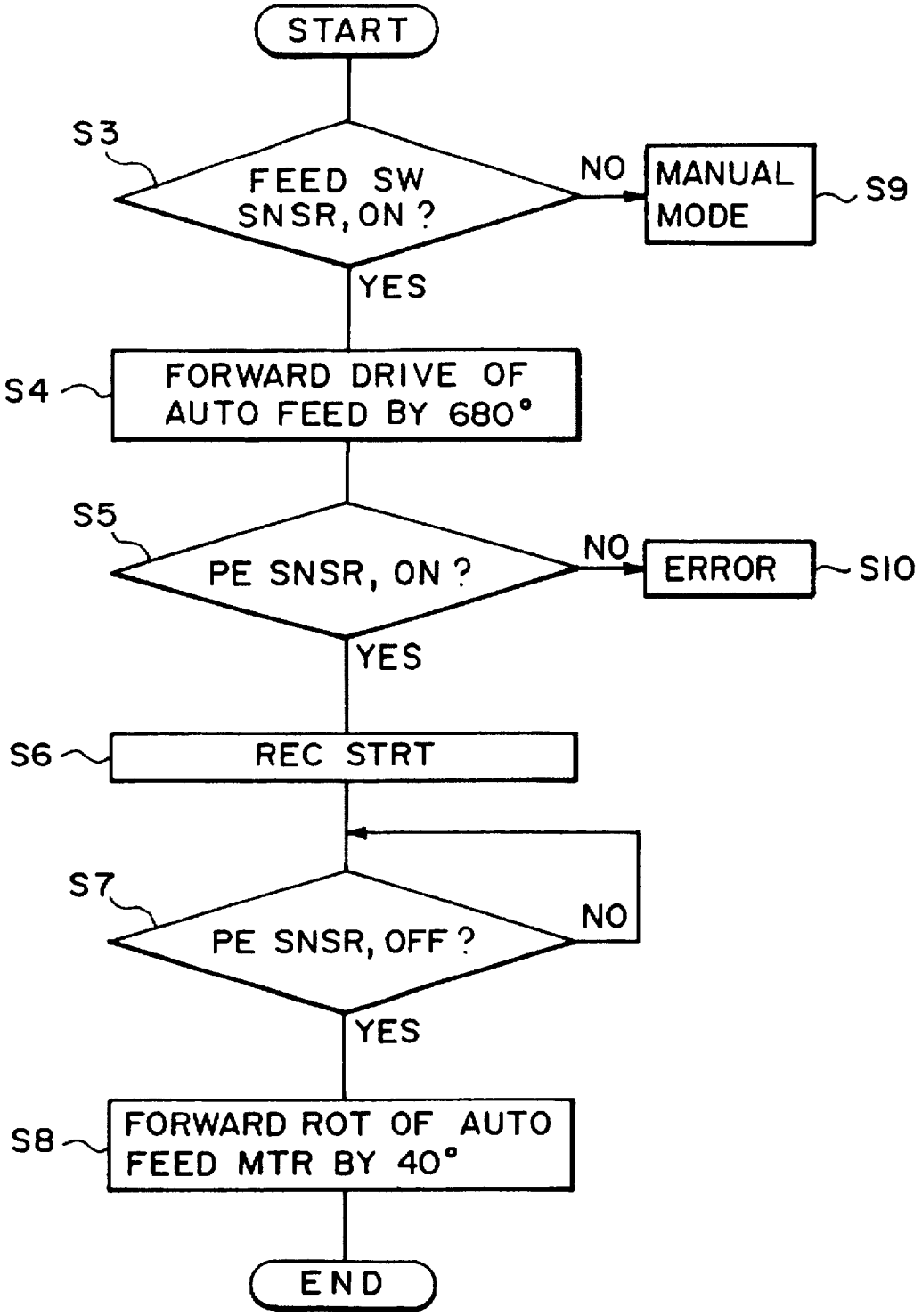
FIG. 41 is a flow chart of controlling operations for the automatic sheet feeder shown in FIG. 33.

FIG. 41 is a flow chart of an example of control operation for the automatic sheet feed. The sheet feed instruction is deemed as the start. First, at step S3, if the sheet feed switching sensor **320*b* is off, the operation proceeds to step S9, and the controller deems the non-usable state of the automatic sheet feeder, and therefore, the manual feeding mode is established. At step S3, if the sheet feed switching sensor 320*b* is in the on-state, the operation proceeds to step S4, and the automatic sheet feeding motor 323 is rotated in the forward direction. At the position of 320 degree rotation of the cam shaft 318, the automatic sheet feeding motor 323 is stopped. That is, the state (5) of FIG. 37. In step S5, the state of PE sensor 14 of the ink jet recording apparatus is detected. If it is off, it means that erroneous sheet feeding operation, and therefore, the operation proceeds to step S10, where the error (improper sheet feeding or non-paper) is discriminated. If it is on, the operation proceeds to step S6**, so that the recording operation is started.

In step S7, the state causing the PE sensor 14 to be deactuated, is searched. When it becomes in the off-state, the operation proceeds to step S8, where the automatic sheet feeding motor 323 is rotated in the forward direction, and is rotated through 40 degrees of the cam shaft 318, and is stopped. This is the state of (2) in FIG. 37. Here, the operation ends, and the system is prepared for the next sheet feeding.

While the invention has been described with reference to the structures disclosed herein, it is not confined to the details set forth and this application is intended to cover such modifications or changes as may come within the purposes of the improvements or the scope of the following claims.

What is claimed is:

1. An automatic sheet feeding apparatus comprising:

sheet supporting means for supporting sheets;

an auxiliary roller for feeding the sheets supported on said sheet supporting means;

separating means, having a separation roller and friction separation means, for separating a sheet from the sheets fed by said auxiliary roller one-by-one;

feeding means for feeding the sheet separated by said separating means;

auxiliary roller moving means for moving said auxiliary roller between an operative position where said auxiliary roller is in contact with the sheets supported by said sheet supporting means and an inoperative position where it is away therefrom;

separation roller moving means for moving said separation roller between an operative position where said separation roller is in contact with the sheet fed by said auxiliary roller for separating the sheet one by one with said friction separating means and an inoperative position where said separation roller is away therefrom, wherein the separation roller moving means supports the separation roller on a drive shaft which is rotatable supported, the drive shaft being provided with a cam that with one full rotation moves the separation roller between the operative position and the inoperative position, and wherein one full rotation of said drive shaft causes one full rotation of the cam;

wherein said separation roller moving means moves said separation roller from the operative position to the inoperative position after said auxiliary roller moving means moves said auxiliary roller from the operative position to the inoperative position after said feeding means starts to feed the sheet separated by said separating means.

2. An apparatus according to claim 1, wherein said separation roller is supported on a driving shaft which is swingable about one end portion thereof, and the other end of the driving shaft is provided with a separation roller cam, and wherein the separation roller cam is rotated by one rotation of the driving shaft to swing the driving shaft, so that the separation roller is moved between the operative position and the inoperative position.

3. An apparatus according to claim 2, wherein said separation roller is in the form of a cylinder, and is contactable to said friction separating means only at one longitudinal end, and a tapered surface is formed at said contactable end.

4. An apparatus according to claim 1, further comprising friction separation means faced to said auxiliary roller.

5. An apparatus according to claim 1, wherein said auxiliary roller is supported on a driving shaft which is translatable, and an end of the driving shaft is provided with an auxiliary roller cam, and wherein said auxiliary roller cam is rotated by one rotation of the driving shaft to translate the driving shaft, so that said auxiliary roller is moved between the operative position and the inoperative position.

6. An apparatus according to claim 5, wherein said auxiliary roller has a large radius portion and a small radius portion, and said large radius portion is contacted to the sheet in the operative position, and the small diameter portion is away from the sheet in the inoperative position.

7. An apparatus according to claim 1, wherein said separation roller and said auxiliary roller receive driving force from a common driving source.

8. An apparatus according to claim 1, further comprising a sheet regulating guide for regulating a lateral edge of the sheet along a sheet feeding direction, and said separation roller and said auxiliary roller feed the sheet inclinedly to abut it to the sheet regulating guide.

9. A recording apparatus comprising:

sheet supporting means for supporting sheets;

an auxiliary roller for feeding the sheets supported on said sheet supporting means;

separating means, having a separation roller and friction separation means, for separating a sheet from the sheets fed by said auxiliary roller one-by-one;

feeding means for feeding the sheet separated by said separating means;

a recording station for effecting recording on the sheet fed by said feeding means;

auxiliary roller moving means for moving said auxiliary roller between an operative position where said auxiliary roller is in contact with the sheet supported by said sheet supporting means and an inoperative position where it is away therefrom;

separation roller moving means for moving said separation roller between an operative position where said separation roller is in contact with the sheet fed by said auxiliary roller for separating the sheet one-by-one with said friction separating means and an inoperative position where said separation roller is away therefrom, wherein the separation roller moving means supports the separation roller on a drive shaft which is rotatably supported, the drive shaft being provided with a cam that with one full rotation moves the separation roller between the operative position and the inoperative position, and wherein one full rotation of said drive shaft causes one full rotation of the cam;

wherein said separation roller moving means moves said separation roller from the operative position to the inoperative position after said auxiliary roller moving means moves said auxiliary roller from the operative position to the inoperative position after said feeding means starts to feed the sheet separated by said separating means.

10. An apparatus according to claim 9, wherein said recording station comprises an electrothermal transducer actuated in accordance with a signal, wherein said electrothermal transducer heats ink beyond film boiling to create a bubble to eject the ink.

11. An automatic sheet feeding apparatus according to claim 1, further comprising a separation slope, disposed upstream of said separating means, for restricting movement of the sheet other than the sheet separated by said separation means when said separation roller is moved to the non-operative position.

12. An automatic sheet feeding apparatus comprising:

sheet supporting means for supporting sheets;

an auxiliary roller for feeding the sheets supported on said sheet supporting means;

separating means, having a separation roller and a friction separation means, for separating a sheet from the sheets fed by said auxiliary roller one-by-one;

feeding means for feeding the sheet separated by said separating means;

auxiliary roller moving means for moving said auxiliary roller between an operative position in which said auxiliary roller is in contact with the sheet supported by said sheet supporting means and an inoperative position in which said auxiliary roller is away from the sheet;

separation roller moving means for moving said separation roller between an operative position in which said separation roller is in contact with the sheet fed by said auxiliary roller for separating the sheet one-by-one with said friction separating means and an inoperative position in which said separation roller is away therefrom, wherein the separation roller moving means supports the separation roller on a drive shaft which is rotatably supported, the drive shaft being provided with a cam that with one full rotation moves the separation roller between the operative position and the inoperative position, and wherein one full rotation of said drive shaft causes one full rotation of the cam;

a sheet stopper, disposed between said separation roller and said auxiliary roller, and movable between an operative position in which insertion of the sheets to said separation roller is restricted, and inoperative position in which sheet feeding is permitted;

wherein in a sheet feed waiting state, said separation roller moving means and said auxiliary roller moving means move said separation roller and said auxiliary roller to the inoperative position, and said sheet stopper is at the operative position.

13. An apparatus according to claim 12, wherein when the sheet is fed out, said auxiliary roller and said separation roller move to the respective operative positions, and said sheet stopper moves to its inoperative position, and after said feeding means starts its feeding operation, said separation roller and said auxiliary roller are moved to their inoperative positions.

14. An apparatus according to claim 13, wherein said sheet stopper has a stopper cam, and by rotation of the stopper cam said sheet stopper moves between its operative position and its inoperative position.

15. A recording apparatus comprising:

sheet supporting means for supporting sheets;

an auxiliary roller for feeding the sheets supported on said sheet supporting means;

separation means, having a separation roller and a friction separation means, for separating a sheet from the sheets fed by said auxiliary roller one-by-one;

feeding means for feeding the sheet separated by said separating means;

a recording station for effecting recording on the sheet fed by said feeding means;

auxiliary roller moving means for moving said auxiliary roller between an operative position in which said auxiliary roller is in contact with the sheet supported by said sheet supporting means and an inoperative position in which said auxiliary roller is away from the sheet;

separation roller moving means for moving said separation roller between an operative position in which said separation roller is in contact with the sheet fed by said auxiliary roller for separating the sheet one-by-one with said friction separating means and an inoperative position in which said separation roller is away therefrom, wherein the separation roller moving means supports the separation roller on a drive shaft which is rotatable supported, the drive shaft being provided with a cam that with one full rotation moves the separation roller between the operative position and the inoperative position, and wherein one full rotation of said drive shaft causes one full rotation of the cam;

a sheet stopper, disposed between said separation roller and said auxiliary roller, and movable between an operative position in which insertion of the sheets to said separation roller is restricted, and inoperative position in which sheet feeding is permitted;

wherein in a sheet feed waiting state, said separation roller moving means and said auxiliary roller moving means moves said separation roller and said auxiliary roller to the inoperative position, and said sheet stopper is at the operative position.

16. An apparatus according to claim 15, wherein said recording station comprises an electrothermal transducer actuated in accordance with a signal, wherein said electrothermal transducer heats ink beyond film boiling to create a bubble to eject the ink.

17. An automatic sheet feeding apparatus comprising:

sheet supporting means for supporting sheets;

an auxiliary roller for feeding the sheets supported on said sheet supporting means, said auxiliary roller having a large radius portion contactable with the sheets and a small radius portion maintained out of contact with the sheets;

separation means, having a separation roller and friction separation means, for separating a sheet from the sheets fed by said auxiliary roller;

feeding means for feeding the sheet separated by said separation means;

separation roller moving means for moving said separation roller between an operative position where said separation roller is in contact with the sheet fed by said auxiliary roller for separating the sheet one-by-one with said friction separating means and an inoperative position where said separation roller is away therefrom, wherein the separation roller moving means supports the separation roller on a drive shaft which is rotatably supported, the drive shaft being provided with a cam that with one full rotation moves the separation roller between the operative position and the inoperative position, and wherein one full rotation of said drive shaft causes one full rotation of the cam;

wherein said separation roller moving means moves said separation roller from the operative position to the inoperative position after said small radius portion of the auxiliary roller is opposed to the sheet after said feeding means starts to feed the sheet separated by said separation means.

18. An apparatus according to claim 17, further comprising auxiliary roller moving means for moving said auxiliary roller between an operative position and an inoperative position, wherein said auxiliary roller moving means moves said auxiliary roller from the operative position to inoperative position after said feeding means starts to feed the sheet.

19. A recording apparatus comprising:

sheet supporting means for supporting sheets;

an auxiliary roller for feeding the sheets supported on said sheet supporting means, said auxiliary roller having a large radius portion contactable with the sheets and a small radius portion maintained out of contact with the sheets;

separation means, having a separation roller and friction separation means, for separating a sheet from the sheets fed by said auxiliary rollers;

feeding means for feeding the sheet separated by said separation means;

a recording station for effecting recording on the sheet fed by said feeding means; and separation roller moving means for moving said separation roller between an operative position wherein said separation roller is in contact with the sheet fed by said auxiliary roller for separating the sheet one-by-one with said friction separating means and an inoperative position where said separation roller is away therefrom, wherein the separation roller moving means supports the separation roller on a drive shaft which is rotatably supported, the drive shaft being provided with a cam that with one full rotation moves the separation roller between the operative position and the inoperative position, and wherein one full rotation of said drive shaft causes one full rotation of the cam;

wherein said separation roller moving means moves said separation roller from the operative position to the inoperative position after said small radius portion of the auxiliary roller is opposed to the sheet after said feeding means starts to feed the sheet separated by said separation means.

* * * * *

UNITED STATES PATENT AND TRADEMARK OFFICE

CERTIFICATE OF CORRECTION

PATENT NO. : 5,775,823

DATED : July 7, 1998

INVENTOR(S) : TOSHIHIKO BEKKI, ET AL.

It is certified that error appears in the above-identified patent and that said Letters Patent is hereby corrected as shown below:

ON THE TITLE PAGE, ITEM [56]:

Insert --4,750,853 6/1988 Van Soest et al. 271/246--, --5,228,671 Fish et al. 271/246--, and --5,328,281 7/1994 Narita et al. 400/605--.

COLUMN 1

Line 36, "two" should read --to--.

COLUMN 2

Line 39, "these" should read --this--.

COLUMN 6

Line 12, "can" should read --can be--; and
Line 64, "skilled" should read --the skilled--.

COLUMN 10

Line 5, "a" should read --an--.

COLUMN 12

Line 1, "sensor" should read --sensors--.

COLUMN 13

Line 58, "its" should read --it--.

UNITED STATES PATENT AND TRADEMARK OFFICE

CERTIFICATE OF CORRECTION

PATENT NO. : 5,775,823

DATED : July 7, 1998

INVENTOR(S) : TOSHIHIKO BEKKI, ET AL.

It is certified that error appears in the above-identified patent and that said Letters Patent is hereby corrected as shown below:

COLUMN 15

Line 40, "410" should read --410 is--.

COLUMN 16

Line 2, "much" should read --many--;
Line 16, "stop" should read --stops--;
Line 31, "is" should read --are--; and
Line 55, "in" should read --are in--.

COLUMN 18

Line 30, "is" should read --are--.

COLUMN 20

Line 17, "is" should read --are--; and
Line 18, "is" should read --are--.

COLUMN 22

Line 2, "feed" should read --feeds--.

COLUMN 24

Line 15, "rotatable" should read --rotatably--.

UNITED STATES PATENT AND TRADEMARK OFFICE

CERTIFICATE OF CORRECTION

PATENT NO. : 5,775,823

DATED : July 7, 1998

INVENTOR(S) : TOSHIHIKO BEKKI, ET AL.

It is certified that error appears in the above-identified patent and that said Letters Patent is hereby corrected as shown below:

COLUMN 26

Line 51, "rotatable" should read --rotatably--; and
Line 65, "moves" should read --move--.

Signed and Sealed this

Sixth Day of July, 1999

*Attest:*

*Attesting Officer*

Q. TODD DICKINSON

*Acting Commissioner of Patents and Trademarks*